US008475106B2

(12) United States Patent
Hata

(10) Patent No.: US 8,475,106 B2
(45) Date of Patent: Jul. 2, 2013

(54) BOOKBINDING APPARATUS AND IMAGE FORMING SYSTEM

(75) Inventor: Kiyoshi Hata, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 916 days.

(21) Appl. No.: 11/812,608

(22) Filed: Jun. 20, 2007

(65) Prior Publication Data

US 2008/0219802 A1 Sep. 11, 2008

(30) Foreign Application Priority Data

Mar. 7, 2007 (JP) ..... 2007-056845

(51) Int. Cl.

| | |
|---|---|
| ***B42D 1/00*** | (2006.01) |
| ***B42C 11/00*** | (2006.01) |
| ***B42C 9/00*** | (2006.01) |
| ***B42B 9/00*** | (2006.01) |

(52) U.S. Cl.
USPC ..... 412/16; 281/21.1; 281/26; 412/4; 412/6; 412/7; 412/8; 412/37

(58) Field of Classification Search
USPC ..... 412/4, 7, 8, 9, 12, 16, 18, 19, 24, 412/33, 34, 36, 37, 901, 6, 35; 281/21.1, 281/26
See application file for complete search history.

(56) References Cited

U.S. PATENT DOCUMENTS

| | | | | |
|---|---|---|---|---|
| 1,575,978 | A * | 3/1926 | Dayton | 281/21.1 |
| 1,658,518 | A * | 2/1928 | Davis | 281/26 |
| 1,714,299 | A * | 5/1929 | Davis | 412/16 |
| 2,230,634 | A * | 2/1941 | Williams | 281/26 |
| 4,741,236 | A | 5/1988 | Averill | |
| 6,014,920 | A | 1/2000 | Yamauchi et al. | |
| 6,966,552 | B2 * | 11/2005 | Trovinger et al. | 412/16 |
| 2005/0204882 | A1 | 9/2005 | Van Den Tillart | |
| 2005/0249574 | A1 * | 11/2005 | Honmochi et al. | 412/9 |
| 2007/0045928 | A1 | 3/2007 | Yoshie et al. | |

FOREIGN PATENT DOCUMENTS

| | | |
|---|---|---|
| JP | 10226455 A | 8/1998 |
| JP | 11-035222 | 2/1999 |
| JP | 2004-130436 | 4/2004 |
| JP | 2004-209869 | 7/2004 |

OTHER PUBLICATIONS

Japanese Office Action dated Mar. 31, 2009.
Notification of First Office Action mailed Oct. 11, 2010, in co-pending Chinese Patent Application No. 2007-10193482.7.
European Search Report, Apr. 11, 2012, 7 pages.

* cited by examiner

*Primary Examiner* — Dana Ross
*Assistant Examiner* — Justin V Lewis
(74) *Attorney, Agent, or Firm* — Finnegan, Henderson, Farabow, Garrett & Dunner, L.L.P.

(57) ABSTRACT

A bookbinding apparatus for producing a booklet by coating an adhesive onto a back side of a bundle of sheets and by pasting a book cover onto the back side of the bundle of sheets, comprises: an oblique cutout portion forming section to form a cutout on an edge of each sheet of the bundle of sheets in such a way that an oblique cutout portion is formed along the width of the back side of the bundle of sheets; a sheet bundle accommodating section to accommodate the bundle of sheets on which the oblique cutout portion is formed; a coating section to coat an adhesive on the back side of the bundle of sheets accommodated in the sheet bundle accommodating section; and a bookbinding section to paste a book cover on the adhesive-coated back side of the bundle of sheets so as to produce the booklet.

13 Claims, 22 Drawing Sheets

FIG. 8 ( a )
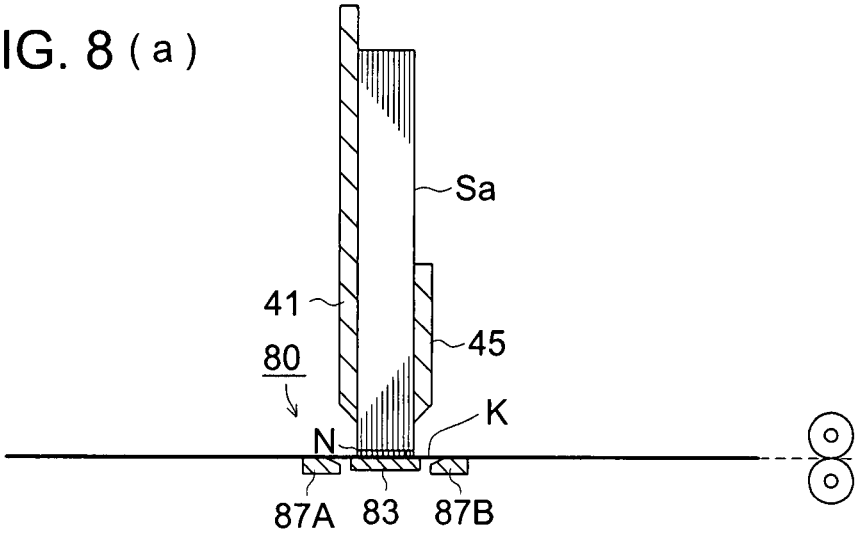
FIG. 8 ( b )
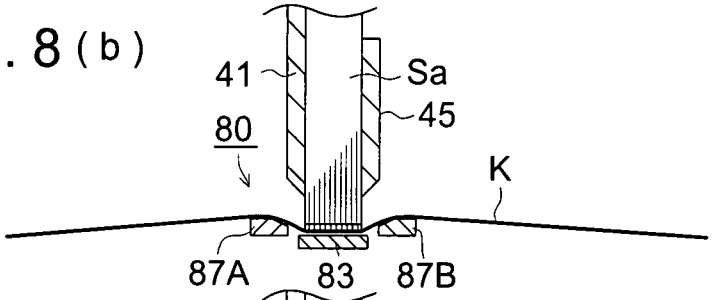
FIG. 8 ( c )
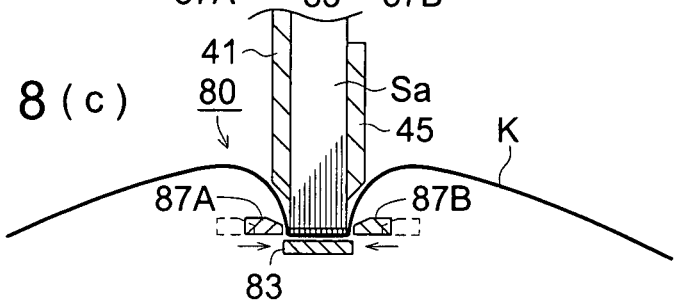
FIG. 8 ( d )
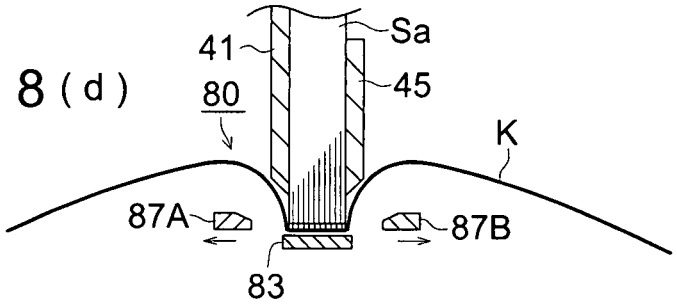

FIG. 9 ( a )
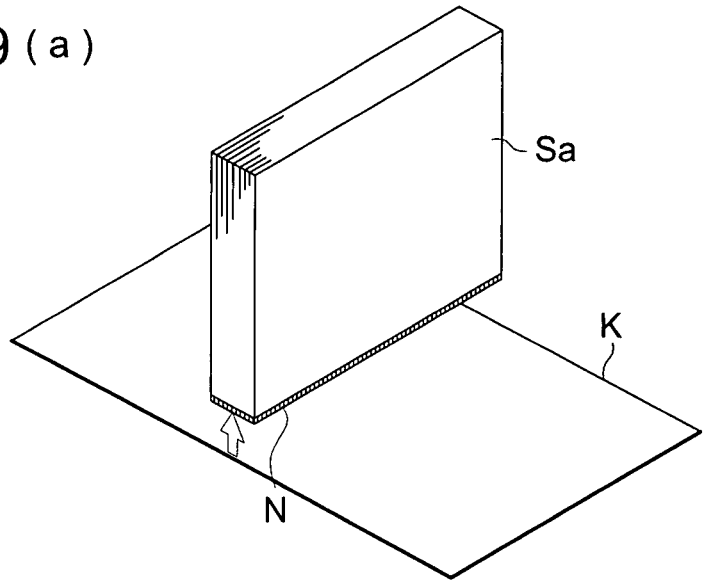
FIG. 9 ( b )
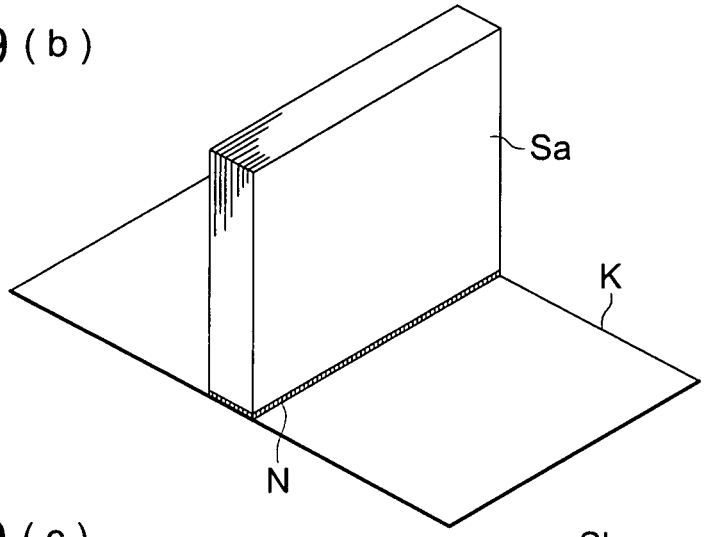
FIG. 9 ( c )
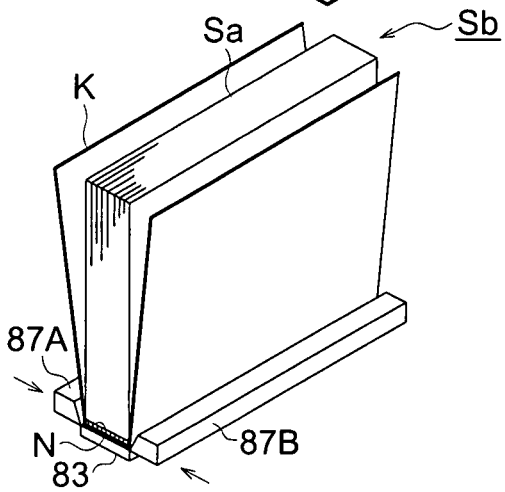

FIG. 11 ( a )
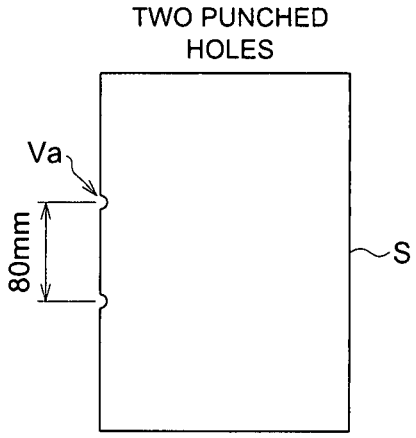
FIG. 11 ( c )
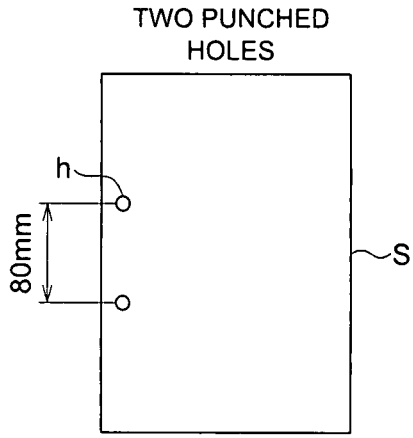
FIG. 11 ( b )
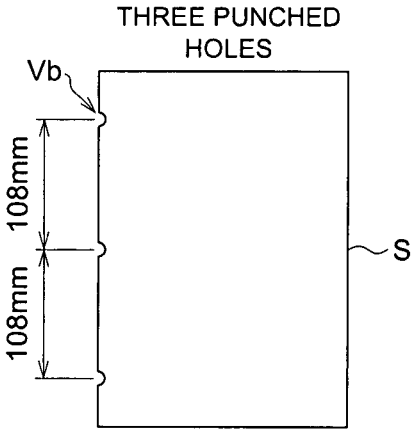
FIG. 11 ( d )
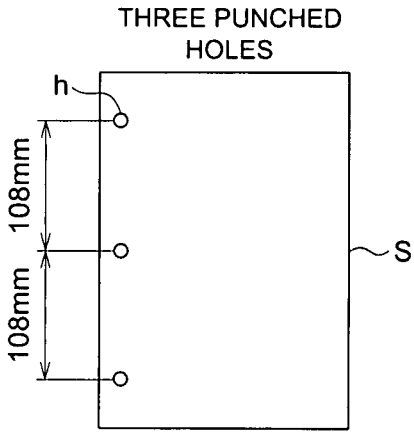

BOOKBINDING APPARATUS AND IMAGE FORMING SYSTEM

This application is based on Japanese Patent Application No. 2007-056845 filed on Mar. 7, 2007, in Japanese Patent Office, the entire content of which is hereby incorporated by reference.

BACKGROUND OF THE INVENTION

The present invention relates to a bookbinding apparatus by which, on the back part of a bundle consisting of a plurality of sheets, an adhesive agent is pasted, and when a book cover K is fixedly adhered to the back part of the sheet bundle, a bulletin is made, and an image forming system.

The image forming apparatus such as a recent electrophotographic system has high speed performance, multifunctions, network function, and when a large capacity sheet feeding apparatus, a large capacity stacker are connected, a purpose of use as a printing apparatus is enlarged. In the case where the image forming apparatus is used as the printing apparatus, when the bookbinding apparatus for bookbinding the prints is connected, by one set of apparatus, the operation from the printing to the bookbinding can be conducted.

A pasting bookbinding apparatus written in the Japanese Paten Application Unexamined Publication Tokkai-No. 2004-209869 is the apparatus in which a sheet bundle accommodating section, paste coating part, book cover supplying part, book cover bending part are tandem arranged in the vertical direction, and down-sized.

A pasting bookbinding apparatus disclosed in the Japanese Paten Application Unexamined Publication Tokkai-No. 2004-209869 is the apparatus by which, on the back part of the sheet bundle accommodated in the sheet bundle accommodating section and held tight, the adhesive agent is uniformly pasted by an adhesive agent pasting roller. Because the adhesive agent is pasted only on the back part of the sheet bundle, the adhesive area is small, and the strength of the pasted book binding is insufficient. Therefore, when the made booklet is opened, there is a case that the adhesion part is peeled and the book cover is dropped.

SUMMARY

An object of the present invention is to provide a bookbinding apparatus by which the adhesion of the back part of the booklet which is pasted to be book-bound, is strengthened, and an image forming system provided with the book-binding apparatus.

The above object can be attained by the following bookbinding apparatus according to one aspect of the present invention.

A bookbinding apparatus for producing a booklet by coating an adhesive onto a back side of a bundle of sheets and by pasting a book cover onto the back side of the bundle of sheets, comprises:

an oblique cutout portion forming section to form a cutout on an edge of each sheet of the bundle of sheets in such a way that an oblique cutout portion is formed along the width of the back side of the bundle of sheets;

a sheet bundle accommodating section to accommodate the bundle of sheets on which the oblique cutout portion is formed;

a coating section to coat an adhesive on the back side of the bundle of sheets accommodated in the sheet bundle accommodating section; and a bookbinding section to paste a book cover on the adhesive-coated back side of the bundle of sheets so as to produce the booklet.

BRIEF DESCRIPTION OF DRAWINGS

FIG. 8 is a sectional view of the booklet forming section showing the bending process of the book cover, and the sheet bundle.

FIG. 9 is a perspective view showing the making process of the booklet by the sheet bundle and the book cover.

FIG. 11 is a plan view of the sheet in which the cut-out part is formed.

DETAILED DESCRIPTION OF THE PREFERRED EMBODIMENT

Figure 1:
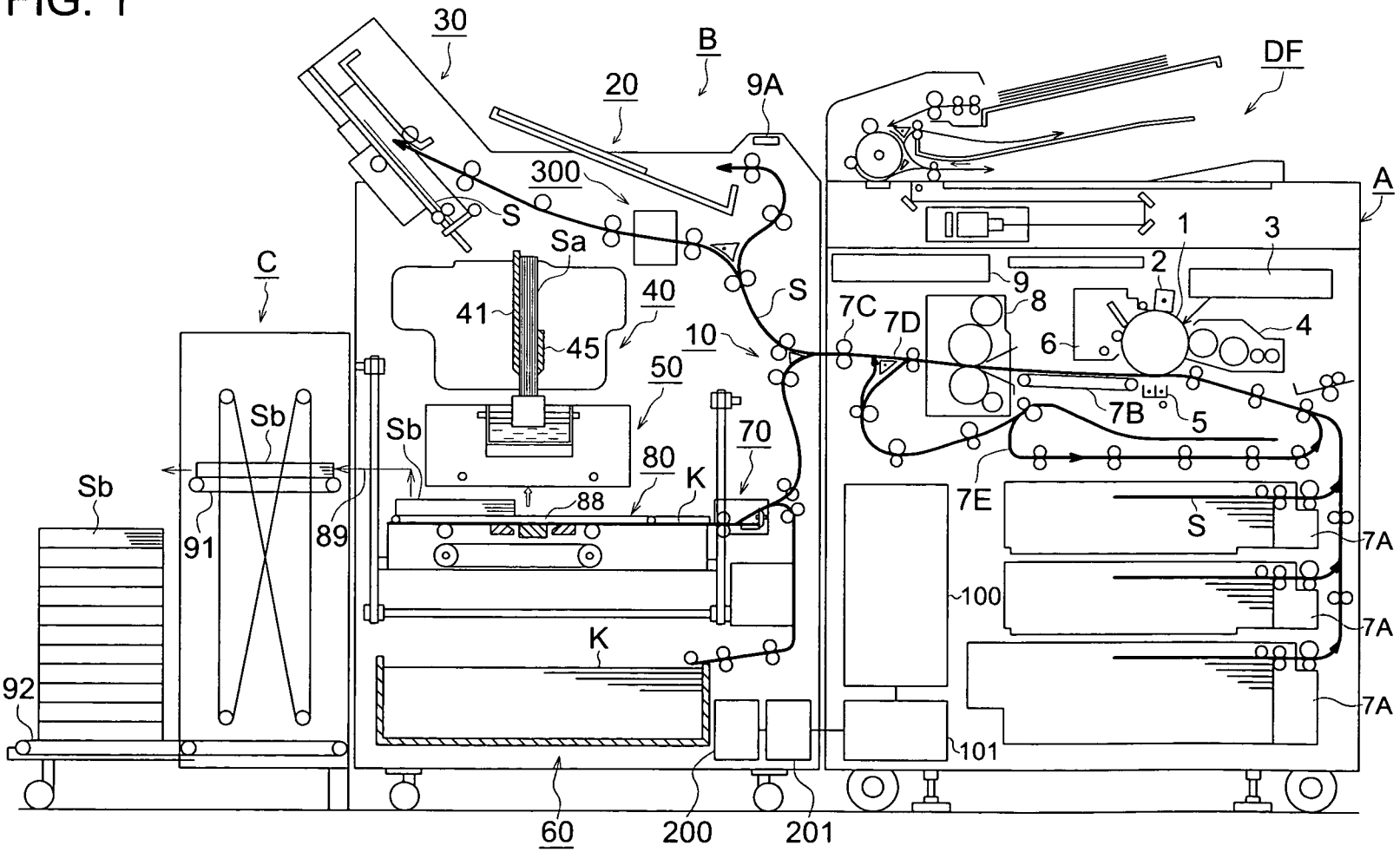
FIG. 1 is an entire structural view of an image forming apparatus main body, and the image forming apparatus provided with a bookbinding apparatus, booklet accommodation apparatus.

Firstly, preferable structures to attain the above object are explained. However, the present invention is not limited to these structures.

1. In a bookbinding apparatus for producing a booklet by coating an adhesive onto a back side of a sheet bundle composed of a plurality of sheets and by pasting a book cover onto the back side of the sheet bundle, the bookbinding apparatus is characterized in that the bookbinding apparatus comprises a cutout forming section to form a cutout on an edge of a sheet; a shifting section to shift the cutout forming section in a sheet width direction perpendicular to a sheet conveying direction; a sheet bundle accommodating section to accommodate the sheet bundle composed of the plurality of sheets on which the cutout portion is formed; a coating section to coat an adhesive on a back side of the sheet bundle accommodated in the sheet bundle accommodating section, wherein the cutout portion is formed on the buck side; and a control section to control the production of the booklet; wherein the control section shifts the cutout forming section in the sheet width direction perpendicular to the sheet conveying direction so as to form the cutout portion, coats an adhesive on the back side of the sheet bundle on which the cutout portion is formed, and pastes a cover sheet to form the booklet.

a bookbinding section to paste a book cover on the adhesive-coated back side of the bundle of sheets so as to produce the booklet.

2. In a bookbinding apparatus for producing a booklet by coating an adhesive onto a back side of a sheet bundle composed of a plurality of sheets and by pasting a book cover onto the back side of the sheet bundle, the bookbinding apparatus is characterized in that the bookbinding apparatus comprises a shift conveying section to shift a sheet in a sheet width direction perpendicular to a sheet conveying direction; a cutout forming section to form a cutout on an edge of a sheet; a sheet bundle accommodating section to accommodate the sheet bundle composed of the plurality of sheets on which the cutout portion is formed; a coating section to coat an adhesive on a back side of the sheet bundle accommodated in the sheet bundle accommodating section, wherein the cutout portion is formed on the buck side; and a control section to control the production of the booklet; wherein the control section shifts a sheet in the sheet width direction perpendicular to the sheet conveying direction, and then forms the cutout portion at the cutout forming section, coats an adhesive on the back side of the sheet bundle on which the cutout portion is formed, and pastes a cover sheet to form the booklet.

3. The bookbinding apparatus described in item 1 or 2, is characterized in that the cutout portion forming section is located at an upstream position of the sheet bundle accommodating section.

4 The bookbinding apparatus described in any one of items 1 to 3, is characterized in that there is further provided with an operating section to select whether or not an oblique cutout portion is formed and to set the selection result.

5. The bookbinding apparatus described in any one of items 1 to 4, is characterized in that the cutout portion forming section comprises a fixed die, a punch, and a driving section to drive the punch to move upwardly or downwardly to come in engagement or disengagement with the fixed die.

6. The bookbinding apparatus described in any one of items 1 to 5, is characterized in that the cutout portion forming section is further used as a punching section to shape a hole on a sheet and the control section controls a stop position of a sheet in accordance with a mode to shape a cutout or a hole.

7. The bookbinding apparatus described in item 1, is characterized in that the control section controls the shift distance of the cutting section based on a condition set for the booklet to be produced.

8. The bookbinding apparatus described in item 2, is characterized in that the control section controls the shift distance of the sheet shifted in the sheet width direction by the shifting section based on a condition set for the booklet to be produced.

9. The bookbinding apparatus described in item 2, is characterized in that the cutout portion forming section comprises a shiftable cutting section shiftable in the sheet width direction perpendicular to a sheet conveying direction and a fixed cutting section fixed at positions in the vicinity of both ends along the sheet width.

10. An image forming system is characterized by comprising:

an image forming apparatus to form an image on sheets; and the bookbinding apparatus described in any one of items 1 to 9 to receive the sheets from the image forming apparatus and to produce a booklet including the sheets.

According to the bookbinding apparatus, and image forming system of the present invention, the adhesive strength of the back part of the booklet which is pasted and book bound, can be strengthen.

The embodiment of the bookbinding apparatus and the image forming system provided with the bookbinding apparatus will be described based on the drawings, however, the present invention is not limited to the present embodiment.

FIG. 1 is an entire structural view of the image forming system provided with an image forming apparatus A, bookbinding apparatus B, booklet accommodation apparatus C, automatic document feeding apparatus DF.

[Image Forming Apparatus A]

The image forming apparatus A has an image forming section in which a charging part 2, image exposing part 3, developing part 4, transfer discharging part 5, and cleaning part 6 are arranged.

The image forming section, after conducts the uniform charge on the surface of the image carrier 1 by the charging part 2, conducts the exposure scanning based on the image data read from the document by the laser beam of the image exposing part 3, and forms the latent image, reversal develops the latent image by the developing part 4, and forms the toner image on the surface of the image carrier 1.

The sheet S fed from the sheet accommodating section 7A, is sent to the transfer position. At the transfer position, after the toner image is transferred onto the sheet S by the transfer discharge part 5, the electric charge of the surface of the sheet S is eliminated, and separated from the image carrier 1, conveyed by the conveying part 7B, successively heated and fixed by the fixing part 8, and delivered from the sheet delivery roller 7C.

When the image formation is conducted on double surfaces of the sheet S, the sheet S heated and fixed by the fixing part 8, is branched from the sheet delivery path by the conveyance path switching part 5, and after switch-backed at the reversal conveyance part 7E, front and rear are reversed, conveyed again to the image forming section, the image is formed on the rear surface of the sheet S, and via the fixing part 8, delivered from the sheet delivery roller 7C to the outside of the apparatus. The sheet S delivered from the sheet delivery roller 7C, is sent into the bookbinding apparatus B.

On the surface of the image carrier 1 after the image formation, the remaining toner on the surface is removed by the cleaning part 6, and ready for the next image formation.

In the upper part of the image forming apparatus A, the operation part 9 provided with the input part and the display part is arranged.

[Bookbinding Apparatus B]

As shown in FIG. 1, the bookbinding apparatus B according to the present invention is a case binding having a conveyance path 10, sheet delivery part 20, reversing part 30, sheet bundle accommodating section 40, adhesive agent pasting part 50, book cover supply part 60, cutting part 70, and booklet forming section 80. Each part of them is tandem arranged in the vertical direction.

Hereupon, the bookbinding apparatus of the present invention can, other than the case bookbinding apparatus, also apply to a flat stitch bookbinding apparatus, center folding center stitch bookbinding, case sealing bookbinding apparatus.

The main control part 100 of the image forming apparatus A and the after processing control part 200 of the bookbinding apparatus are connected by serial communication parts 101, 201.

Figure 2:
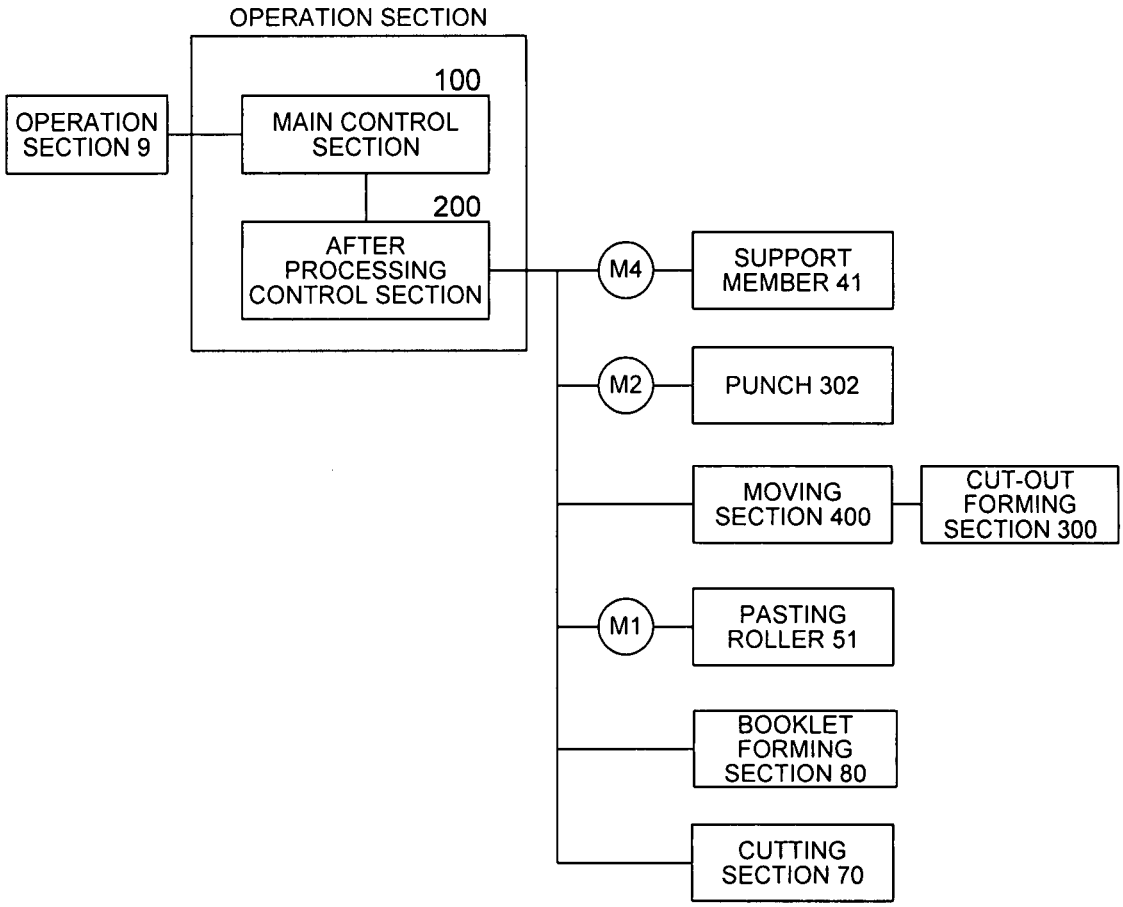
FIG. 2 is a block diagram showing the control of the present invention.

FIG. 2 is a block diagram showing the control of the present invention.

The control part of the present invention is structured by the main control part 100 provided in the image forming apparatus A and the after processing control part 200 provided in the bookbinding apparatus B. By the command of the main control part 100, each part of the bookbinding apparatus B is controlled by the after processing control part 200. In the after processing control part 200, in order to a make booklet, the drive of each part which will be described later, is controlled. That is, the after processing control part 200 controls a motor M4 for driving the support member 41 supporting the sheet bundle, motor M2 for driving the punch 302 of the cut-out forming section 300, movement part 400 for driving the cut-out forming section 300, motor M1 for driving the coating roller 51, and the drive of the booklet forming section 80, cutting part 70.

Figure 3:
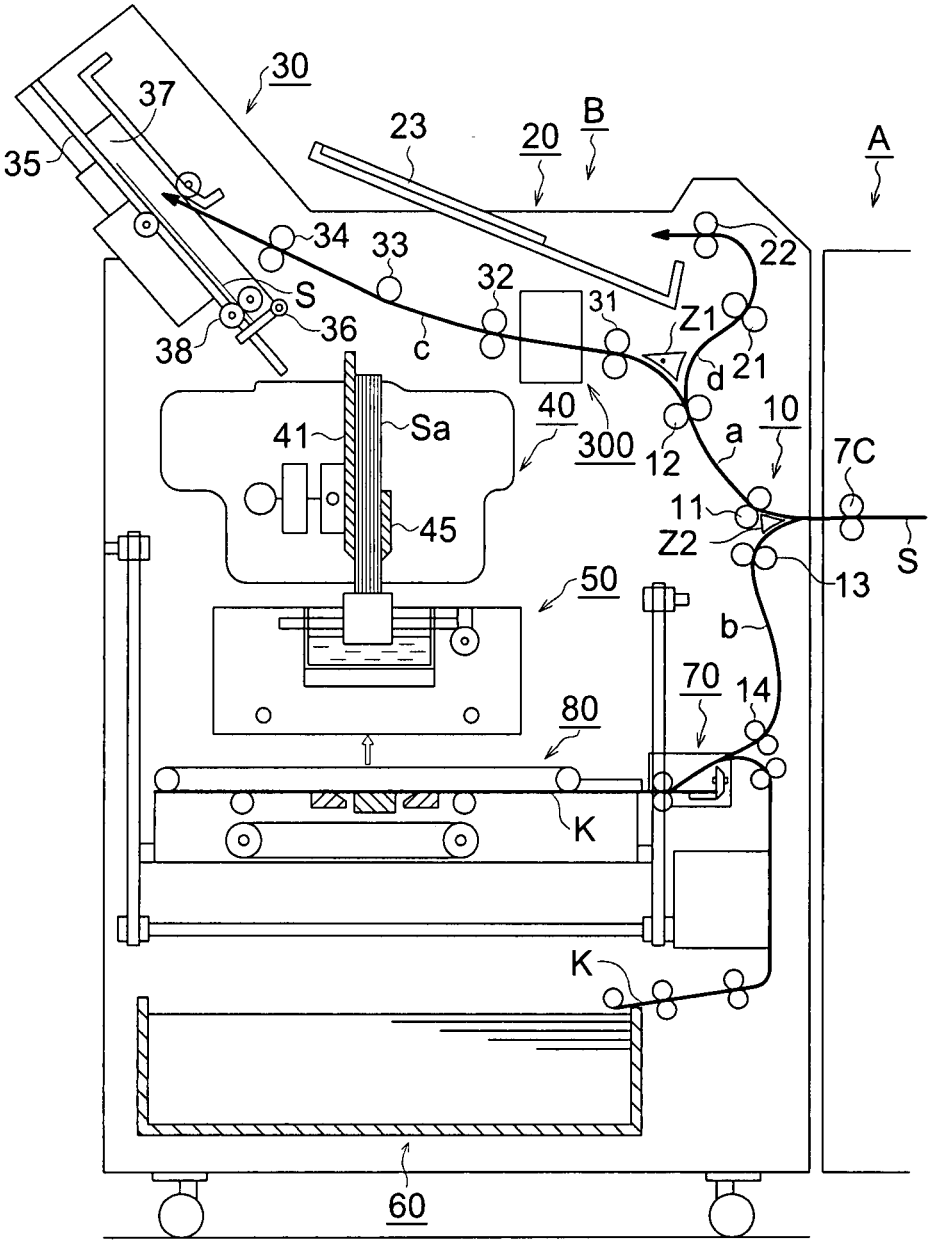
FIG. 3 is a sectional view of the bookbinding apparatus according to the present invention.

FIG. 3 is a sectional view of the bookbinding apparatus B according to the present invention.

(Conveyance Path 10)

The sheet S introduced into the conveyance path a of the conveyance path 10 of the bookbinding apparatus is held tight and conveyed by the conveying rollers 11, 12, and branched to any one of the sheet delivery part 20 and reversing part 30 by the conveyance path switching part Z1.

The conveyance path switching part Z2 arranged upstream side in the sheet conveyance direction of the conveying roller 11 branches the sheet S delivered from the image forming apparatus A to any one of the conveyance path a and the conveyance path b. The sheet S conveyed to the conveyance path b is held tight by the conveying roller 14, and sent into the booklet forming section 80.

(Sheet Delivery Part 20)

When the sheet delivery to the sheet delivery part 20 is set, the conveyance path switching part Z1 shuts off the conveyance path c to the sheet bundle accommodating section 40, and opens the conveyance path d to the sheet delivery part 20.

The sheet S passing the conveyance path d to the sheet delivery part 20 is held tight by the conveying roller 21, conveyed upward, and delivered on the fixed sheet delivery tray 23 of the apparatus uppermost part and accommodated by the sheet delivery roller 22. On the fixed sheet delivery tray 23, the sheet S delivered from the image forming apparatus A can be directly accepted, and maximum 200 sheets can be stacked.

(Reversing Part 30)

The sheet S branched to the conveyance path c by the conveyance path switching part Z1 is held tight by the conveying rollers 31, 32. 33, 34, and accommodated in a predetermined position of the reversing part 30. The reversing part 30 has a sheet placing table 35 arranged slant, swinging sheet back end positioning member 36, aligning member 37 for aligning the sheet S in the sheet width direction, and conveying roller 38.

(Sheet Bundle Accommodating Section 40)

Figure 4:
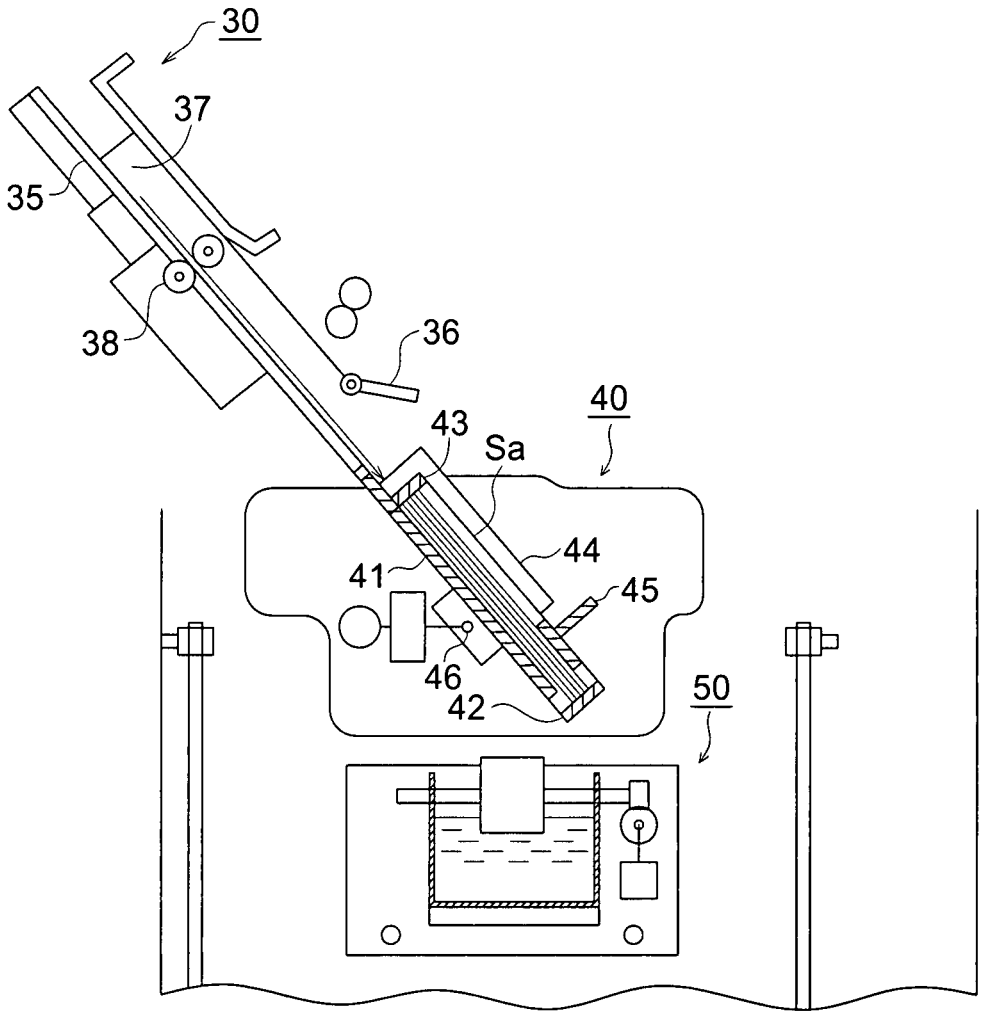
FIG. 4 is a sectional view of the state in which the sheet accumulation part of the sheet bundle accommodating section is arranged in the inclination state.

FIG. 4 is a sectional view of a state in which the sheet cumulated part of the sheet bundle accommodating section 40 is arranged in the slant state.

The sheet bundle accommodating section 40 has a supporting member 41, receiving plate 42, lateral aligning member 44, pressing member 45.

The sheet S placed on the sheet placing table 35 of the reversing part 30 is held tight by the conveying roller 38, delivered from the aperture released by the oscillation of the positioning member 36 which positions the sheet trailing edge, and conveyed slantingly to lower side. The sheet S is successively accommodated in the sheet bundle accommodating section 40, and piled up.

The sheet bundle accommodating section 40 has the support member 41 having the slant piling surface, oscillating receiving plate 42, the sheet S elevated down from the reversing part 30 slides down on the piling surface of the slant support member 41, the leading edge part of the sheet S comes into contact with the receiving plate 42, and is stopped, and the sheet S is supported in the slant state.

The tandem aligning member 43 presses the trailing edge part of the sheet S and forces the leading edge part of the sheet S to come into contact with the receiving plate 42, and conducts the tandem aligning for aligning the leading edge of the sheet S, corresponding to the size of the sheet S placed on the piling surface of the support member 41.

The sheet S successively delivered from the image forming apparatus A is switch back-conveyed in the reversing part 30, piled up in the sheet bundle accommodating section 40, and the tandem aligning and lateral aligning which will be described later, are conducted, and the sheet bundle Sa composed of a plurality of sheets S is formed.

The size of the sheet S and the number of sheets of the sheet bundle Sa which are set condition of the booklet are set in the operation part 9 of the image forming apparatus A shown in FIG. 1. Alternatively, it is set in the outside device such as the personal computer connected to the image forming apparatus A.

The lateral aligning member 44, when the on-line system in which the system from the image formation to the bookbinding processing is automatically conducted, is started, presses the side edge of the sheet S conveyed from the reversing part 30 and accommodated in the sheet bundle accommodating section 40, and conducts the lateral aligning in the sheet width direction.

When the off-line system in which the bookbinding processing is independently conducted, is started, the electric power of the lateral aligning member 44 is released, and the width direction of the sheet bundle accommodated from the outside in the sheet bundle accommodating section 40 is aligned by the manual operation of the lateral aligning member 44.

The pressing member 45 presses the thickness direction of the sheet bundle Sa piled up in the sheet bundle accommodating section 40, and holds tight. At the stage in which the set number of sheet S is accommodated in the sheet bundle accommodating section 40, the pressing member 45 is driven by the drive part, not shown, and the sheet bundle Sa is nipped and held by the nipping part structured by the support member 41 and the pressing member 45.

Figure 5:
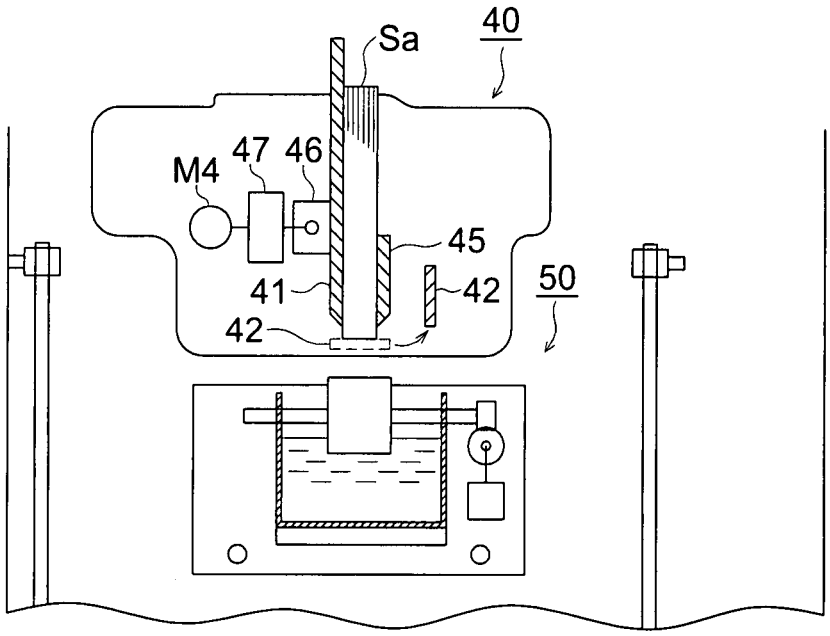
FIG. 5 is a sectional view of the state in which the sheet accumulation part of the sheet bundle accommodating section is arranged in the perpendicular state.

FIG. 5 is a sectional view of the state in which the sheet piling part of the sheet bundle accommodating section 40 is arranged upright.

The support member 41 holding the sheet bundle Sa and the pressing member 45 are rotated around the axis 46 of the sheet bundle accommodating section 40, and the sheet bundle Sa is made from slant state to upright state. In this state, the pasting part 50 is retreated to lower direction, the lower surface of the sheet bundle Sa is separated from the pasting roller 51 of the pasting part 50.

Further, in the state in which the support member 41 and the pressing member 45 hold the sheet bundle Sa, the receiving plate 42 is rotated from the dashed line position to the solid line position shown in the drawings by the drive part, not shown, and retreated.

(Pasting Part 50)

Figure 6:
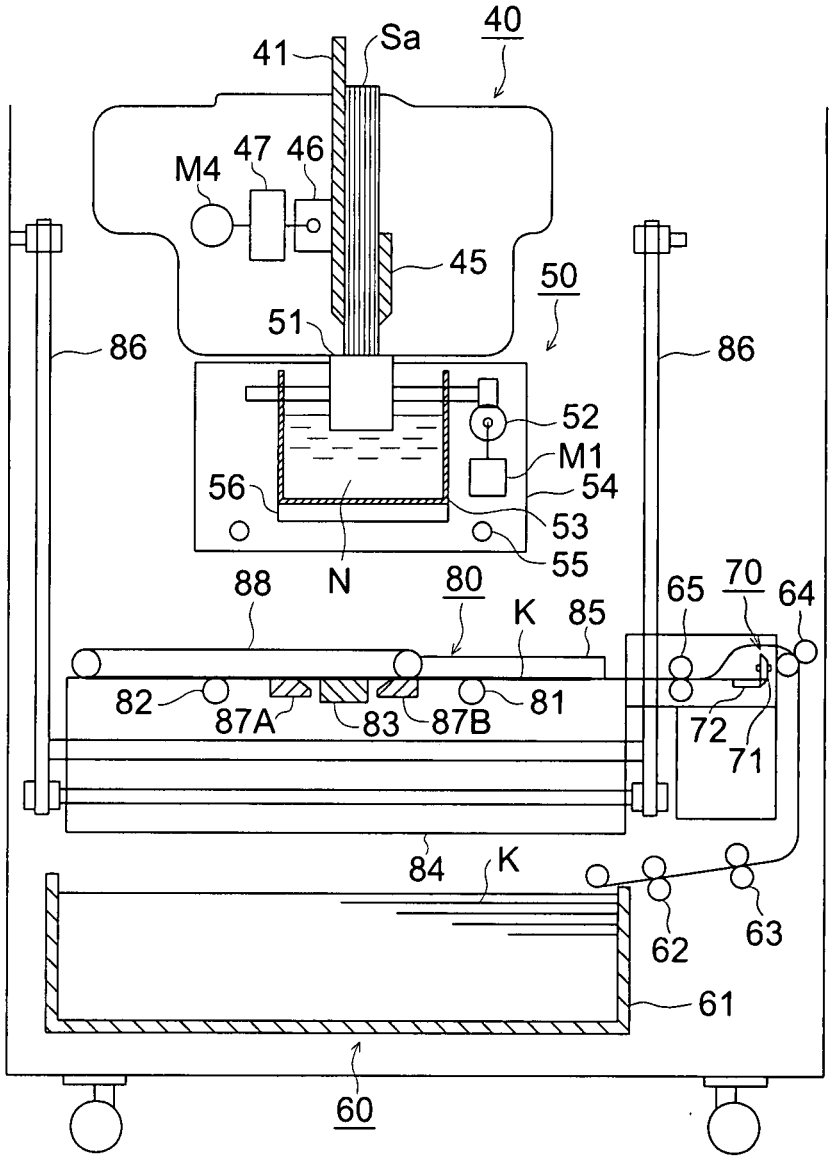
FIG. 6 is sectional views of the sheet bundle accommodating section, pasting part, book cover supplying part, cutting part, and booklet forming section.

FIG. 6 is a sectional view of the sheet bundle accommodating section 40, pasting part 50, book cover supply part 60, cutting part 70, and booklet forming section 80.

The pasting part 50 has the pasting roller 51, drive part 52 for rotation driving the pasting roller 51, vessel 53 for accommodating the adhesive agent N such as the paste, moving body 54 which supports the vessel 53 and is movable from the initial position of the rear surface side of the bookbinding apparatus B to the pasting position of the front surface side, moving section 55 for reciprocally moving the moving body 54, and heating part 56 for heating the adhesive agent N accommodated in the vessel 53.

(Pasting of the Adhesive Agent to the Sheet Bundle)

The moving body 54 of the pasting part 50 is moved by the drive part 47 in the direction which is parallel in the lower surface longitudinal direction of the sheet bundle Sa held in the upright state by the nipping part composed the support member 45 and the pressing member 45.

The moving body 54 starts the movement from the initial position of the rear surface side of the bookbinding apparatus B, is moved along the moving section 55, after stopped at a predetermined position on the rear surface side of the bookbinding apparatus B, and reversely driven and returned to the initial position.

Figure 7:
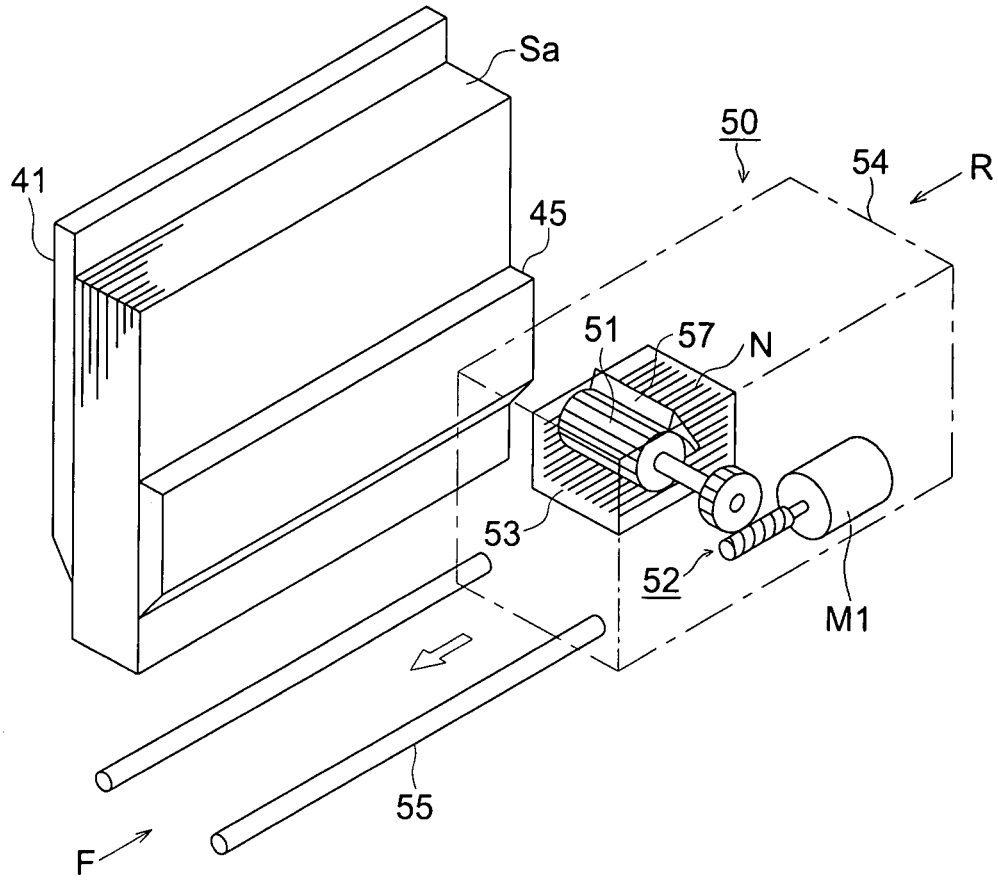
FIG. 7 is a perspective view of the pasting part and tight holding part.

FIG. 7 is a perspective view of the pasting part 50 and the nipping part.

By the motor M1 and drive part 52, the pasting roller 51 submerged in the adhesive agent vessel 53 which accommodates the adhesive agent is rotated. By the movement or reciprocal movement of the moving section 54, the adhesive agent pasting roller 51 pastes the adhesive agent N from the rear surface side R of the lower surface longitudinal direction of the sheet bundle Sa held in the upright state to the front surface side F.

In the adhesive agent N pasted on outer peripheral surface of the rotating pasting roller 51, the layer thickness of the adhesive agent N is regulated by the regulating member 57 and equalized.

(Book Cover Supply Part 60)

As shown in FIG. 6, the book cover K which is the book cover accommodated in the book cover piling part 61 of the book cover supply part 60 is separated, sent by the sheet supply part 62, held tight by the conveying rollers 63, 64, 65, and conveyed to the booklet forming section 80.

(Cutting Part 70)

In the upper part, which is shown, of the book cover supply part 69, integrally structured cutting part 70 in the right part, which is shown, of the booklet forming section 80, which will be described later, cuts the length in the conveying direction of the book cover K to a predetermined length by the rotary cutter composed of rotating blade 71 and the fixed blade 72.

The predetermined length is a length in which the length of 2 sheets in the advancing direction of the sheet S is added to the length of the back strip part of the sheet bundle Sa. For example, in the case where the book cover K is pasted on the back strip of the sheet bundle Sa formed of A4 size sheets S, and the case binding processing is conducted, when the maximum number of sheets of the sheet bundle Sa is 300, and the thickness is about 30 mm, the predetermined length is set to 450 mm in which 2 times of the short side length 210 mm of A4 size sheet is added to the thickness 30 mm of the sheet bundle Sa, and the end part of the book cover K is cut. For the total length for the cutting of the book cover K, a wide size more than 450 mm is used.

Also when each sheet S of A5 size, B5 size, 8.5×11 inch (1 inch is 25.4 mm) size is case bookbinding processed, and the booklet Sb is made, corresponding to the short side length and the sheet bundle thickness, the predetermined length is set.

When, in the operation part 9 of the image forming apparatus A or the outside device, the sheet size, number of sheets, sheet bundle thickness are selection set or detected, the control part sets the cutting predetermined length of the book cover K. The length before cutting of the book cover K is previously determined corresponding to the sheet maximum number of sheets, and accommodated in the book cover piling part 61 of the book cover supply part 60.

(Booklet Forming Section 80)

The booklet forming section 80 has conveying rollers 81, 82 which receive the book cover K supplied from the book cover supply part 60 and convey, and stop at a predetermined position, pressing member 83 which pressure-contacts the book cover K to the adhesive agent pasting surface of the sheet bundle Sa, moving casing 84 which supports the conveying rollers 81, 82 and pressing member 83, aligning part 85, and elevator part 86 by which the moving casing 84 can be moved in the vertical upper and down direction.

The booklet forming section 80 and the booklet delivery belt 88 are integrally elevated by the elevator part 86.

When the booklet forming section 80 stops at the downside position and introduces the book cover K, the aligning part 85 is moved from the initial position corresponding to the size of the book cover K and the both-side surfaces of the book cover K before the cutting processing in the width direction are pressed and width aligned. The book cover K which is width aligned and the bending is corrected, is switch backed in the reversal direction to the introduction direction, conveyed to the cutting part 70 and cut at a predetermined position.

Further, before the booklet forming section 80 adheres the book cover K after the cutting to the rear part of the sheet bundle Sa and pastes at the downside position, the aligning part 85 is moved again from the initial position and presses the both side surfaces in the width direction of the book cover K and conducts the width aligning, and the book cover K is stopped at a predetermined position. After that, the aligning part 85 returns to the initial position in the manner that the book cover K and the sheet bundle Sa do not remove the drawback from the joining, and continuously, the booklet forming section 80 is elevated up. At the elevation, the book cover K is supported at a predetermined position. Accordingly, when the aligning part 85 arranged in the booklet forming section 80 which can be elevated up and dawn, positions the book cover width direction before and after the cutting of the book cover K by the cutting part 70, the improvement of the cutting accuracy of the sheet cover, the improvement of the positioning accuracy of the sheet bundle Sa and the book cover K, and the simplicity of the structure are attained.

The elevating part 86, when the left and right belts are rotated, moves the moving casing 84 to the upper position. In this elevated position, the central part of the book cover K piled on the pressing member 83 is pressure-contacted with the pasting surface of the adhesive agent of the sheet bundle Sa and adhered. After the pasting processing completion of the adhesive agent to the sheet bundle Sa, the pasting part 50 is moved backward and retreated.

(Book Cover Folding Processing)

In the upper part of the booklet forming section 80, the book cover folding part is equipped. The book cover folding part has a pair of left and right symmetric shaping members 87A, 87B. The shaping members 87A, 87B can be contacted and separated in the thickness direction of the sheet bundle Sa. The shaping members 87A, 87B fold the book cover K along the side edge of the pasting surface of the adhesive agent of the sheet bundle Sa, and paste up the front book cover and the rear book cover to the front and rear surfaces of the sheet bundle Sa.

After the completion of the folding process of the book cover K, by the downside elevating drive of the elevating part 86, the booklet forming section 80 is elevated down a predetermined amount and retreated and stopped. After that, when the nipping by the nipping part is released, the booklet Sb is dropped, and the back part of the lower surface of the booklet Sb comes into contact with the upper surface of the booklet delivery belt 88, and is piled and delivered.

FIG. 8 is a sectional view of the booklet forming section 80 showing the folding process of the book cover K, and the sheet bundle Sa, FIG. 8(*a*) shows the book cover folding start time, FIG. 8(*b*) shows the book cover folding middle time, FIG. 8(*c*) shows the book cover folding completion time, and FIG. 8(*d*) shows the book cover folding pressuring release time.

FIG. 9 is a perspective view showing the making process of the booklet Sa formed of the sheet bundle Sa and the book cover K. FIG. 9(*a*) is a perspective view of the cove sheet K of the state before book cover pasting processing and the sheet bundle Sa, FIG. 9(*b*) is a perspective view of the sheet bundle Sa on which the book cover K is pasted, and FIG. 9(*c*) is a perspective view of the booklet Sb which is made by walnut-folding the book cover K on the sheet bundle Sa.

After the book cover K is adhered to the sheet bundle Sa on which the adhesive agent N is pasted, in the rising state of the booklet forming section 80 shown in FIG. 8, the shaping members 87A, 87B are driven by the drive part not shown. The book cover K is held tight by the shaping members 87A, 87B, deformed from the side edge part of the pasting surface of the adhesive agent of the sheet bundle Sa (refer to FIG. 8(*b*)).

After that, the shaping members 87A, 87B are moved in the horizontal direction to the pasting surface of the adhesive agent of the sheet bundle Sa, press the both side surfaces of the sheet bundle Sa and shape, and form the booklet Sb.

The booklet Sb, as shown in FIG. 1, by the release of the pressing member 45, the nipping is released and drops, and is placed on the upper surface of the delivery belt 88 and delivered in the direction of a booklet delivering port 89, and delivered to the booklet accommodation apparatus C outside the apparatus.

The delivered booklet Sb is placed on the conveying belt 91 which can be elevated, of the booklet accommodation apparatus C, and by the rotation of the conveying belt 91, successively delivered and piled up and accommodated on the sheet delivery table 92.

<Oblique Cutout Portion Forming Section>

Figure 10:
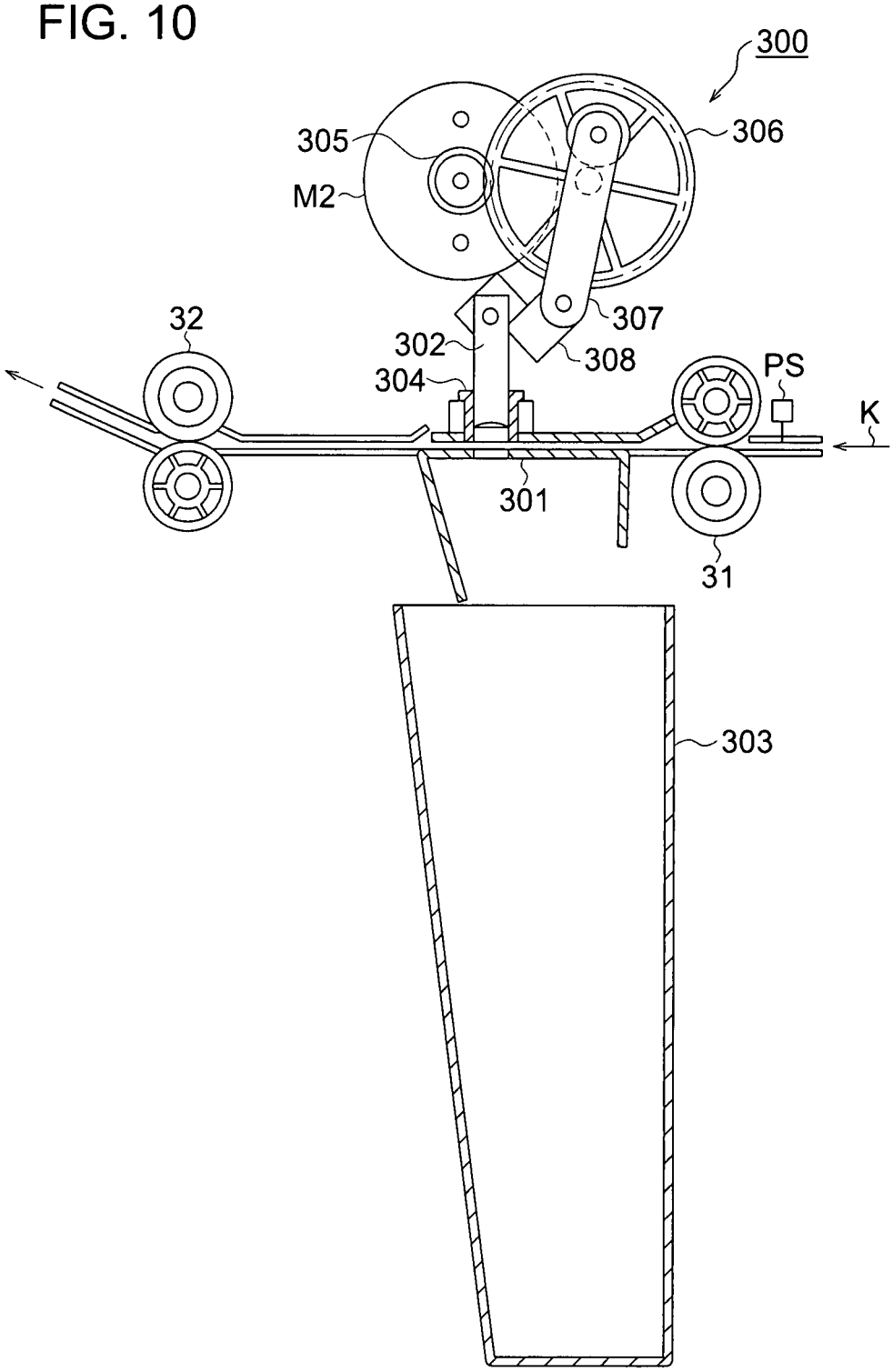
FIG. 10 is a sectional view of a cut-out forming section.

FIG. 10 is a sectional view of the cut-out forming section 300 constituting the oblique cutout portion forming section.

The cut-out forming section 300 is provided with a die 301 fixed to the sheet conveyance path, punch 302 which rises and falls and engages with the die 301, drive part for rising and falling the punch 302, and moving section 400 for moving the cut-out forming section 300 from the back surface side of the bookbinding apparatus B to the front surface side, and the scrap accommodation box 303 for accommodating the cut-out sheet scrap.

The outer peripheral surface of the punch 302 opposite to the die 301 is engaged with the inner surface of the guide member 304 in the manner that it can be rose and fallen. The drive part for rising and falling the punch 302, is provided with the motor M2, small gear 305 connected to the motor M2, large gear 306 engaged with the small gear 305, crank 307 which is engaged on one end of the large gear 306 and can be swingy rotated, drive transmission member such as linking member 308 for linking the crank 307 and the upper part of the punch 302.

By the drive of the motor M2, the punch 302 is rise and fall driven through the small gear 305, large gear 306, crank 307, linking member 308.

By the fall drive of the punch 302 and the engagement with the die 301, the cut-out part is formed in the trailing edge part of the sheet S.

FIG. 11 is a plan view of the sheet S in which the cut-out part and the punched hole are formed.

For the shape of the cut-out part, the shown semi-circle, V-letter shape, U-letter shapes are used. For example, the cut-out part can also be formed by the punch and die used for ordinary sheet file.

In two cut-out parts Va shown in FIG. 11(*a*), the hole diameter is ϕ 6 mm, hole interval is 80 mm. In three cut-out parts Vb shown in FIG. 11(*b*), the hole diameter is ϕ 6 mm, hole interval is 108 mm. In two circular punched holes h shown in FIG. 11(*c*), the hole diameter is 6 mm, hole interval is 80 mm. In three punched holes h shown in FIG. 11(*d*), the hole diameter is ϕ 6 mm, hole interval is 108 mm.

In the operation part 9 of the image forming apparatus A, when punch processing, cut-out processing are not set, the sheet delivered from the image forming apparatus A passes the cut-out forming section 300 without processing, and paste processing of the adhesive agent is conducted.

In the operation part 9, when the punch processing for punching the circular punched hole is set, after the trailing edge part of the sheet S nipped and conveyed by the conveying roller 31, conveying roller 32 detects the passing of the sheet trailing edge part by the sensor PS, predetermined pulses are counted, and the drive of the motor for sheet conveyance, not shown, is stopped, and the advancing of the sheet S is stopped. At this sheet stop position, two or three punch holes h are formed in the vicinity of edge part of the trailing edge part of the sheet S (refer to FIG. 11(*c*), (*d*)).

In the operation part 9, when the punch processing for punching the cut-out parts Va or Vb is set, pulses more than the predetermined pulse count when the punch hole h is punched are counted, after the sheet S is conveyed, two or three cut-out parts Va or Vb are formed in the vicinity of the edge part of the trailing edge part of the sheet S (refer to FIG. 11(*a*), (*b*)).

Figure 12:
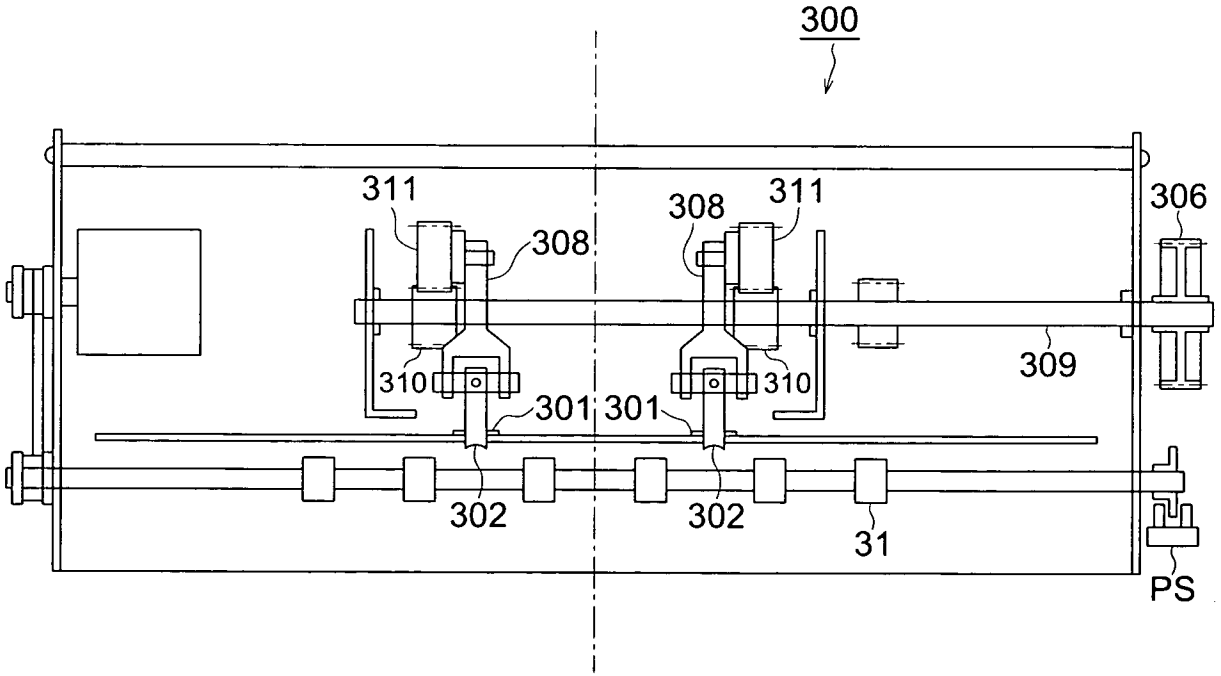
FIG. 12 is a front view of the cut-out forming section.
Figure 13:
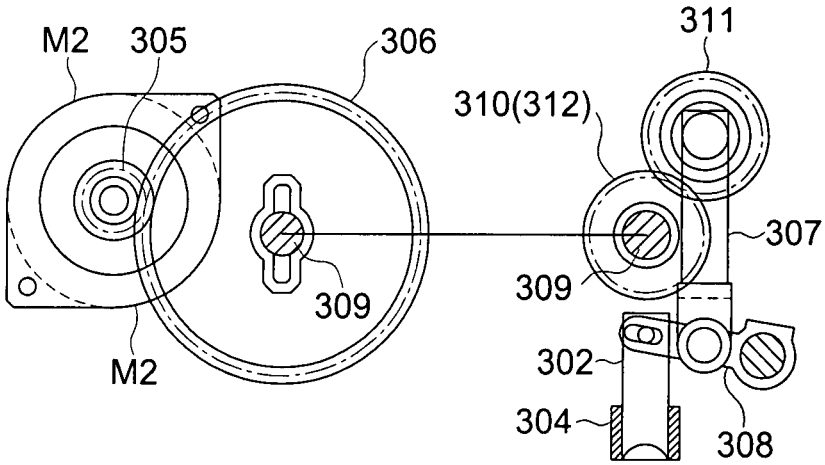
FIG. 13 is a side view showing another embodiment of a drive part for driving a punch of the cut-out forming section.

FIG. 12 is a front view of the cut-out forming section 300, FIG. 13 is a side view showing another embodiment of the drive part 320 for driving the punch 302 of the cut-out forming section 300. Hereupon, as for the symbol used in these views, the same number as in FIG. 10 is given to the part having the same function as FIG. 10.

The cut-out forming section 300 is arranged in between the conveying roller 31 and conveying roller 32. The leading edge part of the sheet S introduced into the bookbinding apparatus B passes the conveying roller 31, cut-out forming position of the cut-out forming section 300 and the conveying roller 32, and stops at the predetermined position. That is, after the sensor PS arranged on the upstream side of the conveying roller 31 detects the passage of the trailing edge of the sheet S, counts the predetermined pulses and stops the drive of the motor for the sheet conveyance, not shown, and stops the advance of the sheet S. At this sheet stop position, the cut-out part Va is formed in the edge part of the trailing edge part of the sheet S.

As shown in FIG. 13, by the drive of the motor M2, rotates the small gear 305, large gear 306, and rotates the rotation shaft 309 to which the large gear 306 is fixed. The gear 310 fixed to the rotation shaft 309 rotates the gear 311. In the gear 310, one way clutch 312 is housed. The crank 307 which is engaged with the de-centering part of the gear 311 and can be oscillation rotated, rise and fall drives the punch 302.

Hereupon, the formation of two cut-out parts Va may also form for each sheet to the conveyed for each sheet S, or a plurality of sheets S are stacked and may also be collectively formed.

(First Embodiment)

Figure 14:
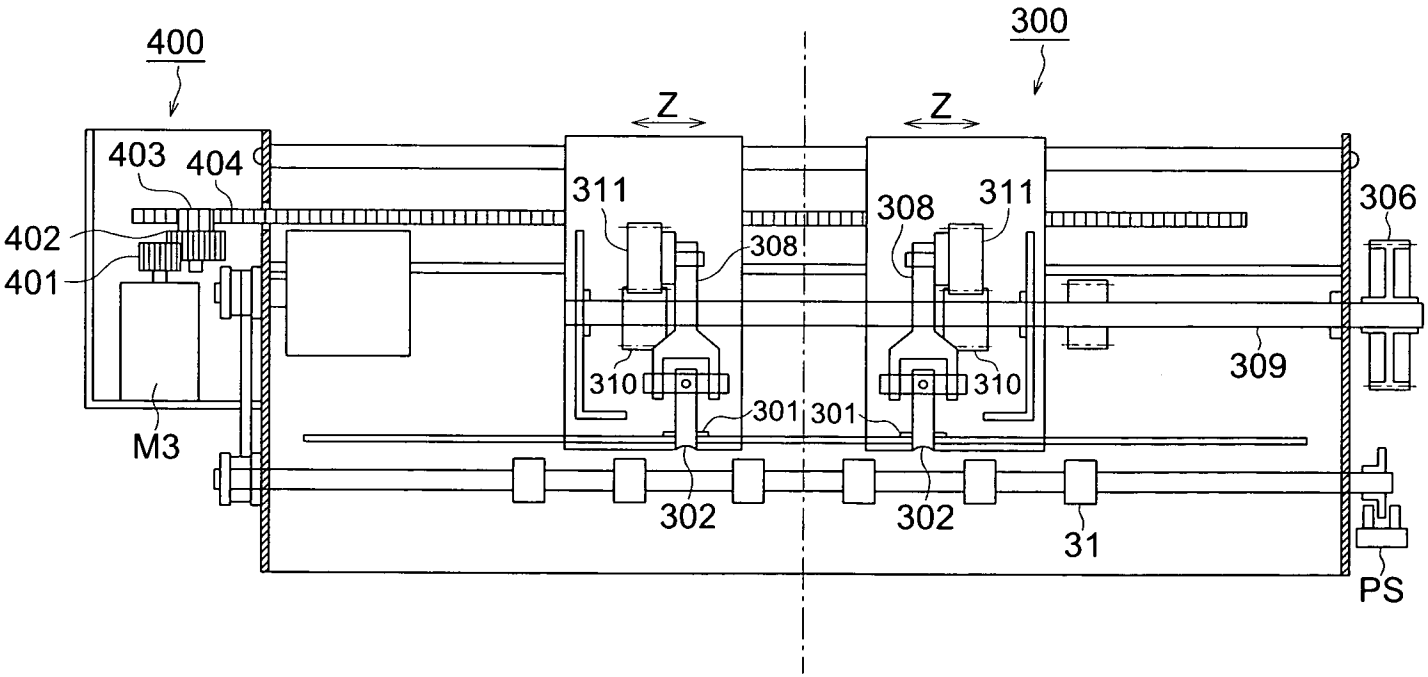
FIG. 14 is a front view of a moving section.

FIG. 14 is a figure showing the first embodiment of the oblique cutout portion forming section, more concretely is a front view of the cut-out forming section 300 and the moving section 400 for moving the cut-out forming section 300 from the back surface side of the bookbinding apparatus B to the front side so as to form an oblique cutout portion.

When the motor M3 is driven, a rack gear 404 is moved in the Z direction through a gear train composed of gears 401, 402, 403. In the rack gear 404, a pair of cut-out forming section 300 having the punch 302 and die 301 is engaged. By the movement of the rack gear 404, the cut-out forming section 300 is moved in the Z direction.

Figure 15:
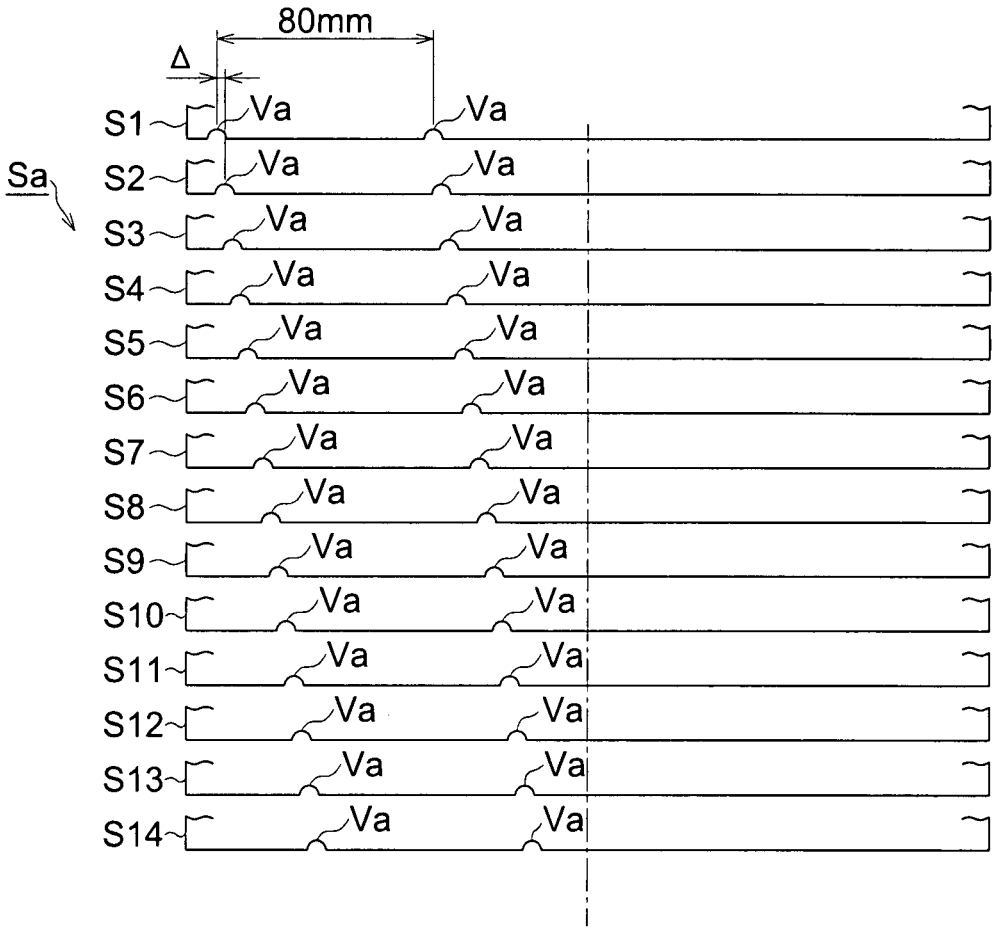
FIG. 15 is a plan view of the sheet bundle in which a plurality of sheets in which the cut-out part is formed, are cumulated.

FIG. 15 is a plan view of the sheet bundle Sa in which a plurality of sheets (s1-S14) in which two cut-out parts Va corresponding to two lines of oblique cutout portions are formed, are integrated.

The cut-out forming section 300 is moved to the left side shown in the drawing, by the moving section 400, and in the first sheet S1, two cut-out parts Va are punched by the punch hole part having two punches 302 and die 301 of the cut-out forming section 300. In the case of two punch holes, the hole diameter is 6 mm, hole interval is 80 mm.

Next, the cut-out forming section 300 is moved to the right side shown in the drawing, by the moving section 400 by the predetermined distance Δ, and in the second sheet S2, two cut-out parts Va are punched by two sets of punch hole parts of the cut-out forming section 300. When the hole diameter of the cut-out part Va is, for example, 6 mm, the predetermined distance Δ is set, for example, to 0.5 mm which is the arrangement in which a part of the hole diameter is overlapped.

Hereinafter, in the same manner, to a plurality of sheets S (S3-S14), the cut-out part Va whose punch hole position is shifted by for each predetermined distance Δ is punched.

(Second Embodiment)

Further, in the second embodiment, in FIG. 10, a shift conveyance part having the drive part for shifting the conveying roller 32 on the downstream side of the sheet conveyance direction of the cut-out forming section 300, so as to shift a sheet S to the sheet width direction which is orthogonal to the sheet conveyance direction is provided. Namely, the shift conveyance part shifts the sheet S which is held tight, to the sheet width direction orthogonal to the sheet conveyance direction by a predetermined distance so as to form an oblique cutout portion, together with the conveying roller 32.

Figure 16:
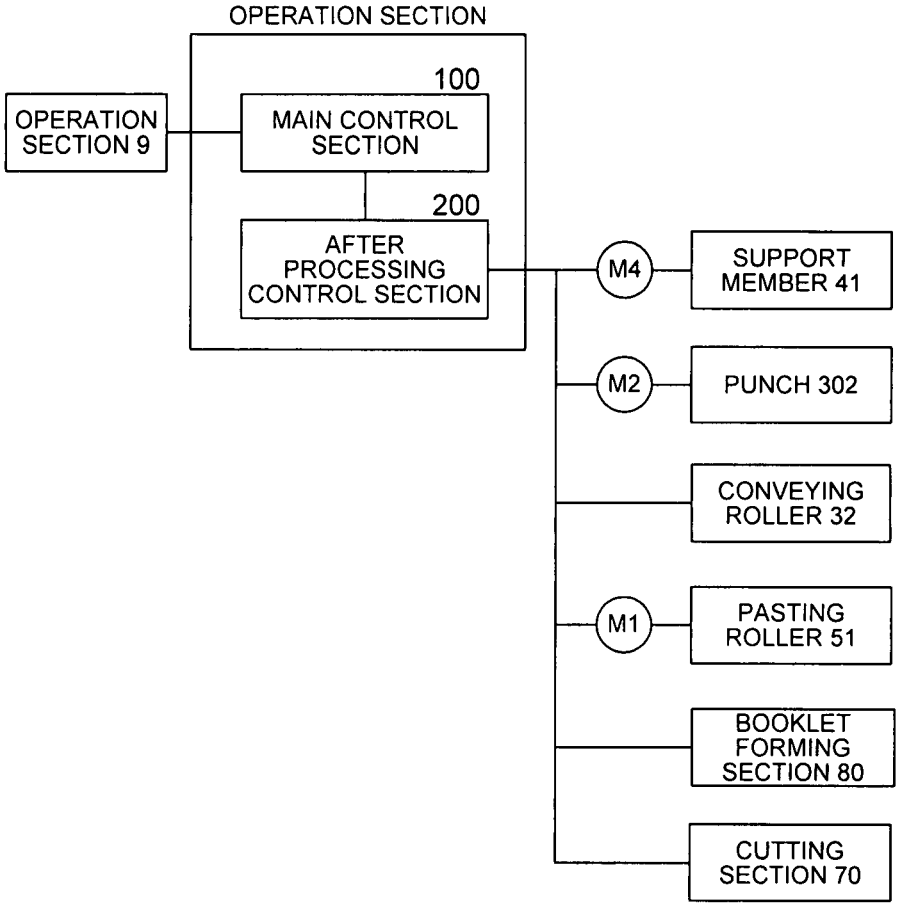
FIG. 16 is a block diagram showing the control of another embodiment.

FIG. 16 is a block diagram showing the control of another embodiment.

In this embodiment, instead of moving section 400 of FIG. 2, the control part for shifting the conveying roller 32 in the shift conveyance part to the sheet width direction, is provided.

By the cut-out forming section 300, after two cut-out parts Va are formed in the first sheet S1 and conveyed, the second sheets S2 is conveyed, and after, by the shift conveyance part, the sheet S2 held together with the conveying roller 32, is shifted to the direction orthogonal to the sheet conveyance direction by a predetermined distance Δ, by the cut-out forming section 300, two cut-out parts Va are formed in the second sheet S2.

Further, qas another embodiment, in FIG. 9, the regulating member for aligning in the sheet width direction is arranged in the vicinity of the cut-out forming section 300, in the state in which the sheet nipping by the conveying roller 32 is released, after the sheet S is shifted to the sheet width direction by the regulating member by a predetermined distance Δ, two cut-out parts Va are formed in the second sheet S2 by the cut-out forming section 300.

In this manner, in following plurality of sheets S, successively the cut-out parts Va whose positions are different, are formed, conveyed to the sheet bundle accommodating section 40, and the sheet bundle Sa is formed.

Figure 17:
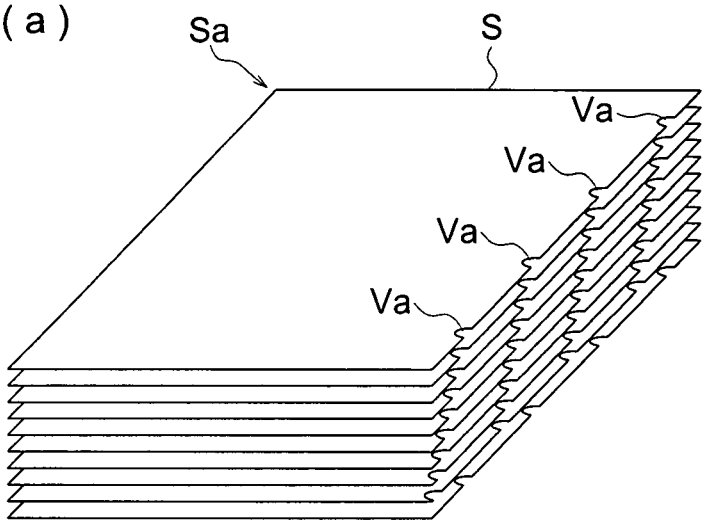
FIG. 17 is a perspective view, front view, and partial enlarged view showing the sheet bundle having the cut-out part.
Figure 17:
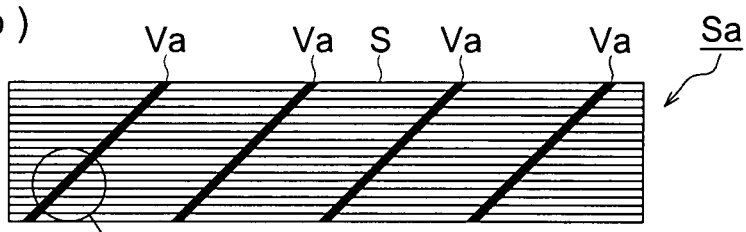
Figure 17:
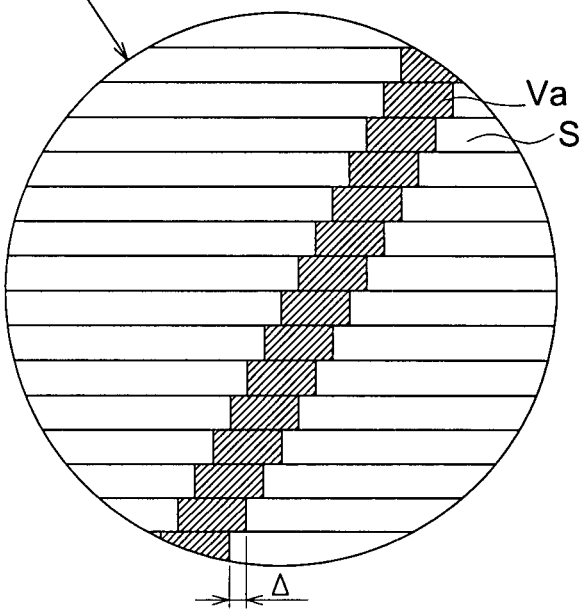

FIG. 17 is a perspective view, front view, and partial enlarged view showing the sheet bundle Sa having four lines of oblique cutout portions.

FIG. 17(*a*) is a perspective view showing the sheet bundle Sa in which the sheets S in which two cut-out parts Va are formed are integrated, FIG. 17(*b*) is a front view of the back part of the sheet bundle Sa, and FIG. 17(*c*) is a partial enlarged view of the back part of the sheet bundle Sa.

In the back part of the sheet bundle Sa, two cut-out part Va between the lamination-like sheets are slantingly arranged as shown in the drawings. Then, in the back part of the sheet bundle Sa, two cut-out parts Va are arranged in almost equal interval, and the adhesive agent entering surface is formed.

In this state, in the back part of the sheet bundle Sa having two cut-out part Va, the adhesive agent N is pasted by the pasting part 50 shown in FIG. 5. The adhesive agent N is pasted on the back part, together with that, enters into two cut-out parts Va, and the adhesive agent surface is formed.

When, in this manner, the adhesive agent is entered into two cut-out parts Va formed in the back part of the sheet bundle Sa, the adhesive strength of the back part of the sheet bundle Sa becomes strong, and when the booklet Sb in which the book cover K is adhered and made is opened, it is prevented that the sheet S of insufficient adhesion is dropped, and the page is lost.

After pasting of the adhesive agent N, the book cover K is adhered to the adhesive agent surface of the back part of the sheet bundle Sa.

Figure 18:
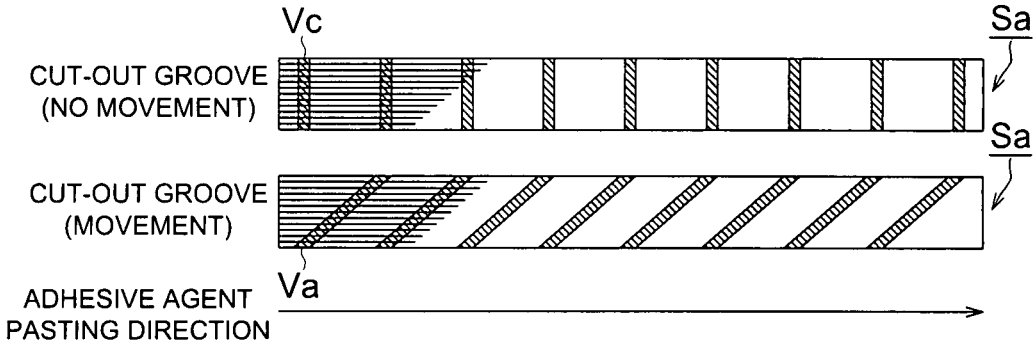
FIG. 18 is a front view of the sheet bundle having the cut-out part.
Figure 18:
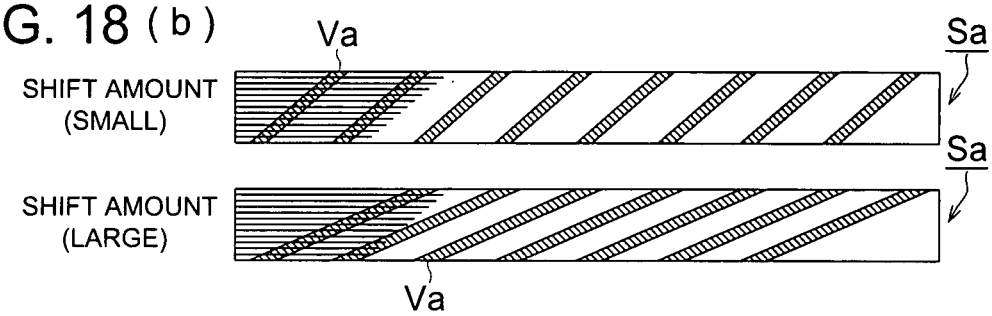
Figure 18:
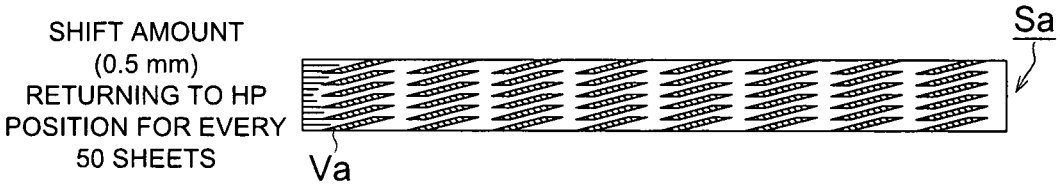

FIG. 18(*a*) is a front view of the sheet bundle Sa in the case of a vertical cutout portion Vc where the cut-out part is not moved or not shifted, and a front view of the sheet bundle Sa in the case of an oblique cutout portion Va where the cut-out part is moved or shifted.

When the cut-out part Vc is not shifted for each sheet, the cut-out part Va formed in the back part of the sheet bundle Sa is orthogonal to the pasting direction of the adhesive agent, when the adhesive agent N is pasted in the cut-out part Vc, temporarily a large amount of adhesive agent N is necessary, it is difficult that the adhesive agent N arrives at the back of the cut-out part Vc, the adhesive strength of the back part of the sheet bundle Sa is partially lowered.

When the cut-out part Va is shifted for each sheet, the cut-out part Va is slant to the pasting direction of the adhesive agent, the pasting amount of the adhesive agent is uniformed, the pasting unevenness of the adhesive agent is decreased, further, the adhesive agent N enters to the back of the cut-out part Va. As the result of that, the strength of the back part of the booklet Sb is increased.

FIG. 18(*b*) is a front view of the sheet bundle Sa showing the change of shift amount of the cut-out part Va.

The upper view shows the sheet bundle Sa whose shift amount is small, and the lower view shows the sheet bundle Sa whose shift amount is large.

When the shift amount of the cut-out part Va is changed to the making condition of the booklet Sb, it can be in some degree selected that the tensile strength of the sheet S is increased, or that the bending strength of the back part of the sheet bundle Sa is increased.

For example, in the coating sheet, it is better that the tensile strength of the sheet S is increased, when the booklet Sb is thick, it is better that the bending strength of the back part is increased.

The shift amount shifting the cut-out part Va for each sheet (a predetermined distance Δ shown in FIG. 15) is appropriately set corresponding to the thickness of the sheet bundle Sa, the kind of sheet.

TABLE 1

| Thickness of sheet bundle (mm) | Shifting amount (a predetermined distance Δ) | | |
|---|---|---|---|
| | Plain paper (mm) | color sheet (mm) | coating sheet (mm) |
| 3 - not more than 10 | 0.1 | 0.2 | 0.5 |
| 10 - not more than 20 | 0.1 | 0.2 | 0.5 |
| 20 - 30 | 0.1 | 0.1 | 0.2 |

Table 1 shows an example of the shift amount depending on the thickness of sheet bundle Sa and the kind of sheet.

In the case of plain paper, in spite of the thickness of the sheet bundle Sa, the shift amount may also be small. In the case of color print sheet, the shift amount is increased little more than the case of plain paper. In the case of the coating sheet, as shown in the lower view of FIG. 16(*b*), the shift amount is set large.

FIG. 18(*c*) is a front view of the sheet bundle Sa showing the forming shape of the cut-out part Va.

In table 1, in the case where shift amount is 0.5 mm, when the position of the punch 301 is returned to the home position for every 50 sheets, for example, in the case of sheets S of 300 sheets, the shift amount becomes 0.5×300=15 mm, as shown in the view, the cut-out part Va whose slant angle is considerably small is formed in the back part of the sheet bundle Sa. When the cut-out part Va is formed in the manner, in the back part of the sheet bundle Sa, the cutout part Va whose density is high is formed, and the adhesive strength of the back part is strengthen.

Figure 19:
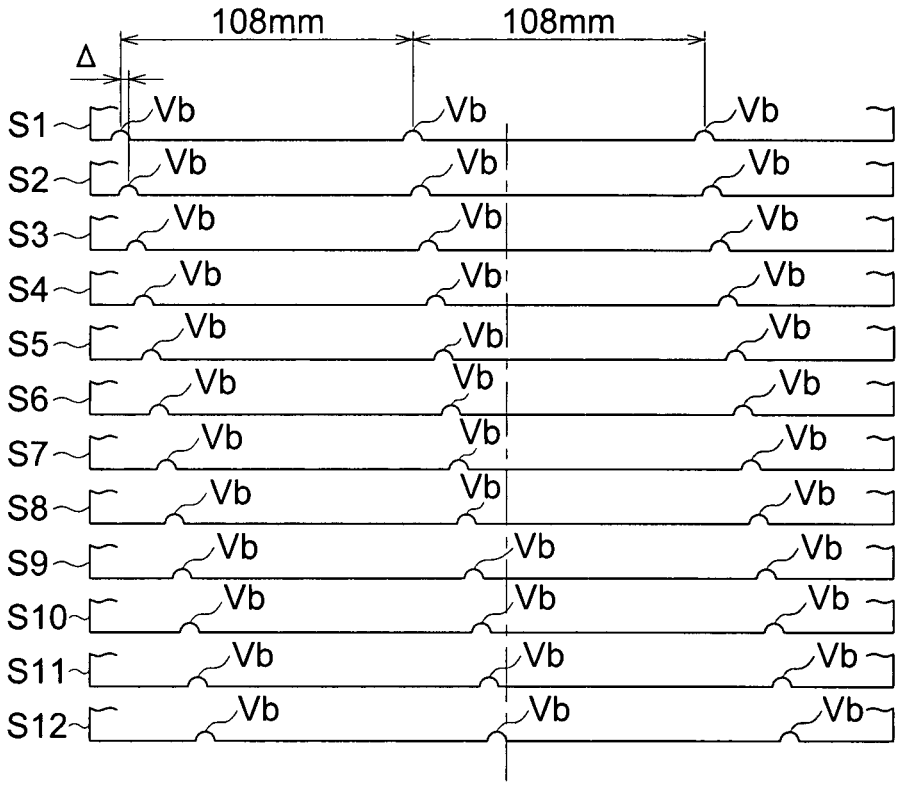
FIG. 19 is a plan view of the sheet bundle in which a plurality of sheets in which 3 cut-out parts are formed, are cumulated.

FIG. 19 is a plan view of the sheet bundle Sa in which a plurality of sheets S1-S12 which form three cutout parts Vb, are integrated.

The cut-out forming section 300 is moved to the left side in the view by the moving section 400, in the first sheet S1, three cut-out parts Vb are punched by 3 sets of punches 302 and dies 301 of the cut-out forming section 300. In the case of this three holes cut-out part, the hole diameter is ϕ 6 mm, the hole interval is 108 mm.

Next, the cut-out forming section 300 is moved to the right side in the view by the moving section 400 by the predetermined distance Δ, in the second sheet S2, two cut-out parts Vb are punched by 3 sets of punches 302 and dies 301 of the cut-out forming section 300. Hereinafter, in the same manner, the cut-out part Vb whose punch phase is shifted for every predetermined distance Δ to a plurality of sheets S (S3-S12), is punched.

Figure 20:
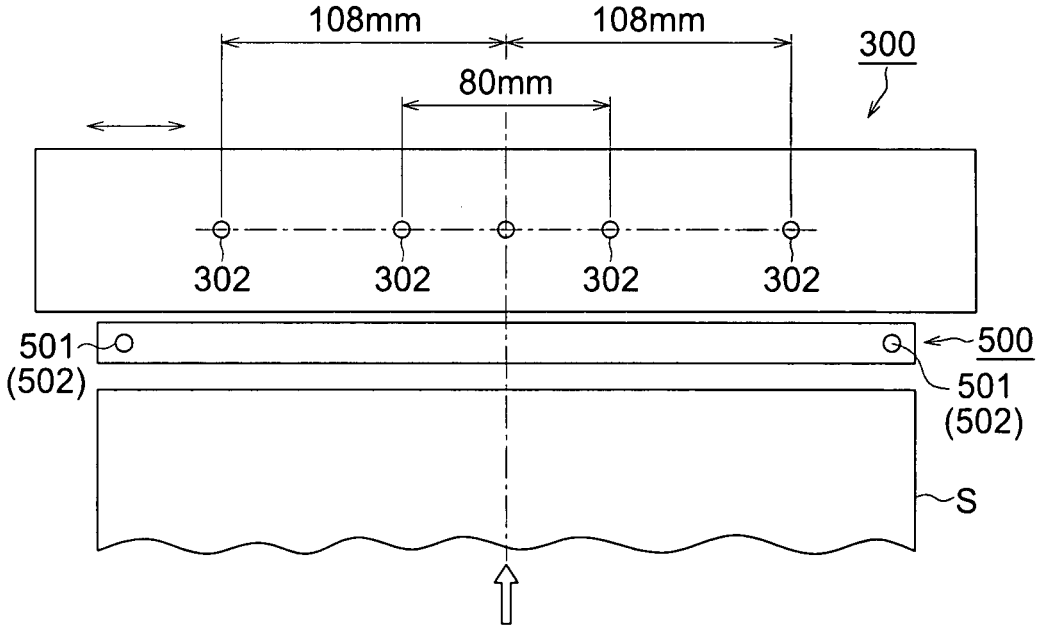
FIG. 20 is a plan view of the movable cut-out forming section, and the cut-out forming section set at the fixed position, and a front view showing another embodiment of the sheet bundle in which the cut-out part is formed.
Figure 20:
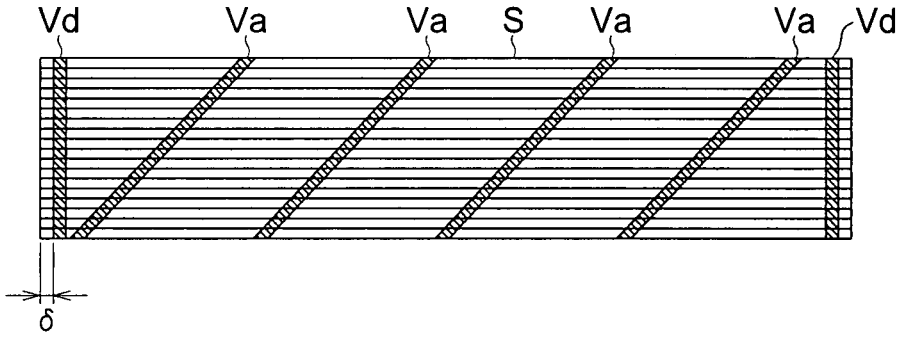

FIG. 20(*a*) is a plan view of the movable cut-out forming section 300, and the cut-out forming section 500 arranged at the fixed position.

The cut-out forming section 300 can form two cut-out parts Va, and three cut-out parts Vb, and switched corresponding to the purpose of use, any one of the cut-out part Va, three cut-out parts Vb is formed.

The punch 502 and die 501 of the cut-out forming section 500 are arranged in the vicinity of both edge part of the sheet width.

FIG. 20(*b*) is a front view showing another embodiment of the sheet bundle Sa in which the sheets s which forms the cut-out part Va, are integrated.

The cut-out forming section has the cut-out part which can be moved in the sheet width direction orthogonal to the sheet conveyance direction, and fixed cut-out part Vd fixedly arranged in the vicinity of both edge part of the sheet width direction.

When in the vicinity of both edge part of the back part of the sheet bundle Sa, the cut-out part Vd in which the position for every sheet is not shifted is formed by the cut-out forming section 500, the adhesive strength in the vicinity of both edge part is increased, the page turning of the sheet edge part is prevented.

In the forming position of the cut-out part Vd, the distance δ from the edge part of the sheet bundle Sa to the edge part of the width of the cut-out part Vd is, for example, set to about 2 mm. When the cut-out part Vd is close to the edge part of the sheet bundle Sa, because there is a possibility that the adhesive agent N pushed from the cut-out part Vd when the book cover K is adhered to the sheet bundle Sa and folded and compressed, is protruded from the sheet bundle Sa, the distance δ in which the adhesive agent N is not protruded, is set.

Figure 21:
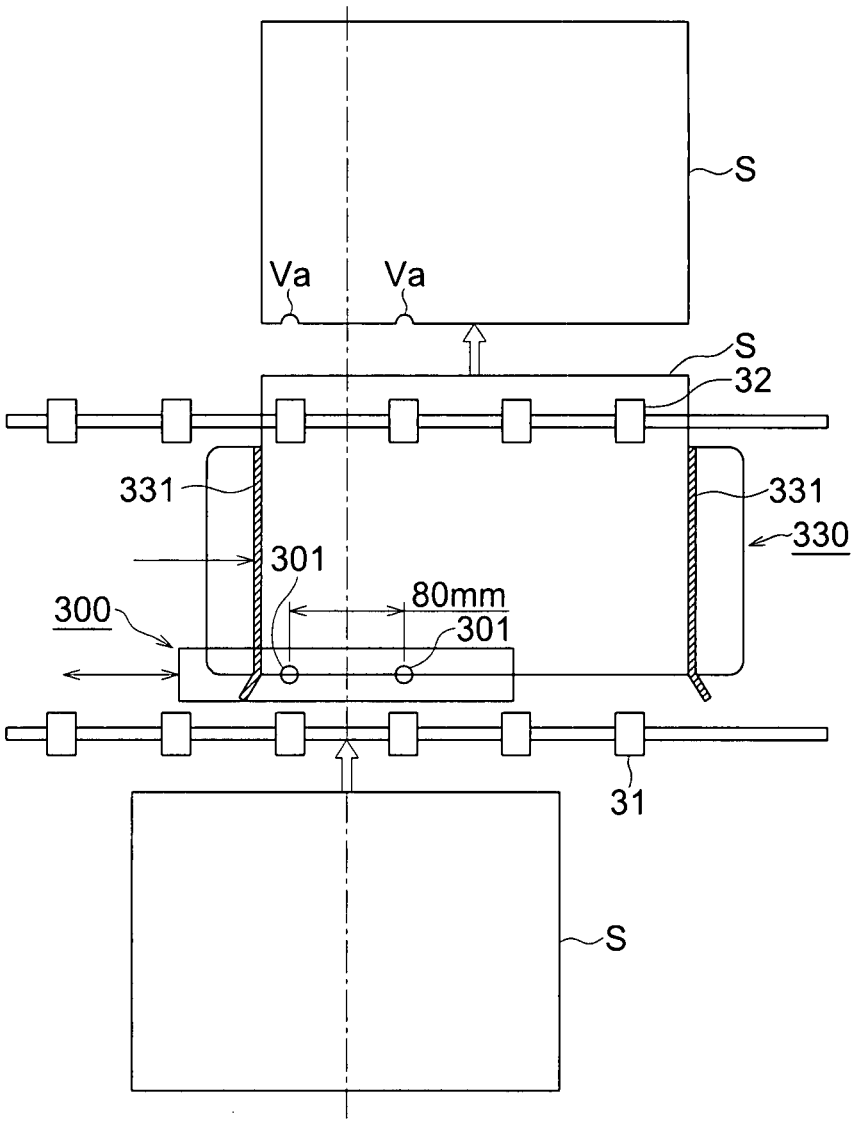
FIG. 21 is a plan view showing other embodiment of the cut-out forming section.

FIG. 21 is a plan view showing yet another embodiment of the cut-out forming section.

In embodiments shown in FIG. 12-FIG. 14, the cut-out forming section 300 is moved in the sheet width direction by the moving section 400, however, any one of the cut-out forming section 300 and sheet S is relatively moved, and the position of the cut-out part Va can also be shifted by the predetermined distance for every conveyed sheet S.

As an example, the shift conveyance part 330 is arranged between the conveying roller 31 and the conveying roller 32. The shift conveyance part 330 has a pair of regulation plates 331 which is aligned in the sheet width direction, and by the drive part, moved in the sheet width direction.

When the cut-out part Va is formed, after a pair of regulation member 331 receive the sheet S at the initial position, the pressure contact of the conveying roller 32 is released, the regulation member 331 is moved in the sheet width direction and stopped, and the cut-out part Va is formed at a predetermined position of the sheet S by the cut-out forming section 300.

After that, the sheet S in which the cut-out part Va is formed is held tight by the pressure contact of the conveying roller 32, the rotation, conveyed to the sheet bundle accommodating section 40. The subsequent sheet S is, after the cut-out part Va is formed at the position which is shifted by a predetermined distance Δ by the sheet conveyance part 330, conveyed to the sheet bundle accommodating section 40.

As another example, instead of the regulation member 331 moving in the sheet width direction, the shift conveyance part having the drive part shifting the conveying roller 32 in the direction orthogonal to the sheet conveyance direction is provided.

When the cut-out part Va is formed, by the pressure contact of the conveying rollers 31, 32, rotation, after the sheet S is received at the initial position, while the sheet S is held tight by the conveying roller s31, 32, the conveying rollers 31, 32 are moved in the sheet width direction, and stopped, and the cut-out part Va is formed at a predetermined position of the sheet S by the cut-out forming section 300.

After that, the sheet S forming the cut-out part Va is held tight by the pressure contact, rotation of the conveying roller 32, conveyed to the sheet bundle accommodating section 40. The subsequent sheet S is, after the cut-out part Va is formed at the position which is shifted by a predetermined distance Δ by the shift conveyance part, conveyed to the sheet bundle accommodating section 40.

Figure 22:
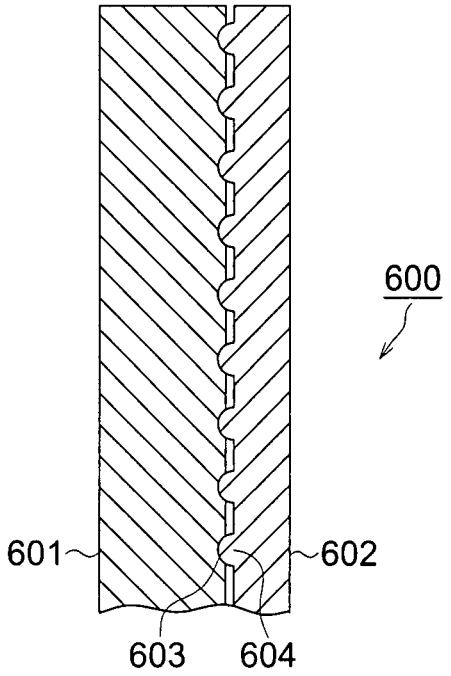
FIG. 22 is a plan view showing another embodiment of a die and punch of the cut-out forming section, and a perspective view.
Figure 22:
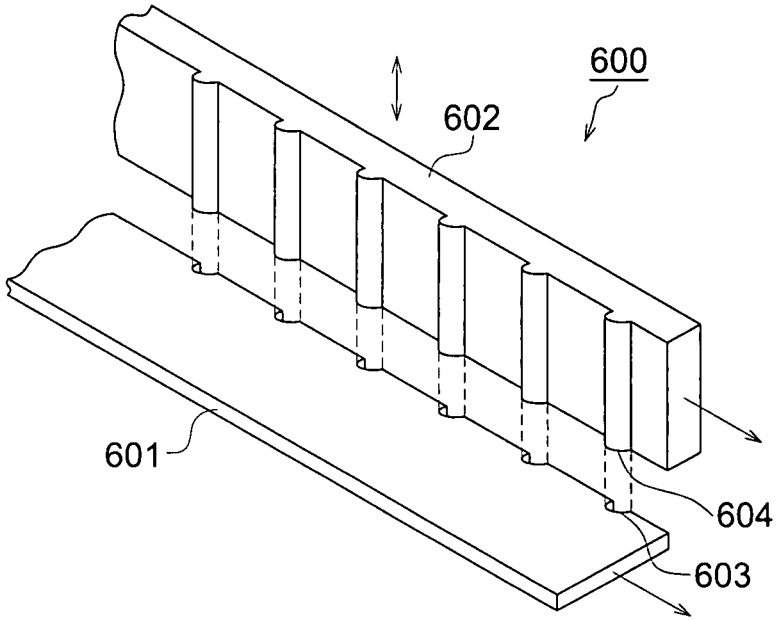

FIG. 22(*a*) is a plan view showing another embodiment of the die 601 and the punch 602 of the cut-out forming section 600, FIG. 22(*b*) is a perspective view of the die 601 and the punch 602.

The die 601 of the cut-out forming section 600 has a plurality of cut-out blade parts 603. A plurality of cut-out blade part 503 of the punch 602 has a plurality of cut-out blade part 604 of the die 601.

In this cut-out forming section, further many cut-out parts compared to two cut-out parts of above described 80 mm interval, three cut-out parts of 108 mm interval can be made by shifting the phase. Further, the shape of the cut-out part is not limited to the semi-circular by the above described die 601, but it can be formed to the shape which is appropriate for entering of the adhesive agent N.

That is, the shape of the cut-out parts Va, Vb, Vd is not limited to the above described semicircular shape notch, each kind of shape is appropriately selected depending on the kind of paper of the sheet S, number of sheets, the nature of the adhesive agent.

Hereupon, the bookbinding apparatus B of the present invention is structures as the independent apparatus, after the sheet S delivered from another image forming apparatus main body, or the sheet S supplied by the sheet feed apparatus connected to the bookbinding apparatus B, is accommodated in the sheet bundle accommodating section 40 shown in FIG. 2, the pasting processing of the adhesive agent and the adhering processing of the book cover are conducted, and the case bookbinding can also be made.

What is claimed is:

1. A bookbinding apparatus for producing a booklet by coating an adhesive onto a back side of a bundle of sheets and by pasting a book cover onto the back side of the bundle of sheets, comprising:

an oblique cutout portion forming section including a first sheet conveying section to convey a sheet one sheet by one sheet, a cutting section that forms a vertically-punched cutout with a predetermined size on an edge of each sheet of the bundle of sheets sequentially one sheet by one sheet conveyed from the first sheet conveying section in such a way that the vertically-punched cutout on a succeeding sheet is formed at a position shifted by a distance smaller than the predetermined size from a position of the vertically-punched cutout on a preceding sheet so that a part of a periphery of the vertically-punched cutout of the succeeding sheet corresponding to the distance is not covered by the preceding sheet so as to form a surface to be coated with an adhesive and an oblique cutout portion is formed along a width of the back side of the bundle of sheets, and a second sheet conveying section to convey each sheet provided with the vertically-punched cutout one sheet by one sheet;

a sheet bundle accommodating section to receive each sheet provided with the vertically-punched cutout one sheet by one sheet from the second sheet conveying section, to stack the sheet provided with the vertically-punched cutout one sheet by one sheet so as to form the bundle of sheets, and to accommodate the bundle of sheets on the back side of which the oblique cutout portion is formed;

a coating section that coats the adhesive on the back side of the bundle of sheets; and a bookbinding section that pastes the book cover on the adhesive-coated back side of the bundle of sheets so as to produce the booklet.

2. The bookbinding apparatus described in claim 1, wherein the oblique cutout portion forming section comprises a cutting section for forming the cutout on the edge of each sheet and a shifting section for shifting the cutting section in a sheet width direction perpendicular to a sheet conveying direction, and wherein the shifting section shifts the cutting section so as to shift a position of the vertically-punched cutout on the edge of each sheet so that the oblique cutout portion is formed along the width of the back side of the bundle of sheets.

3. The bookbinding apparatus described in claim 1, wherein the oblique cutout portion forming section comprises a cutting section for forming the vertically-punched cutout on the edge of each sheet and a sheet shifting section for shifting the sheet in a sheet width direction perpendicular to a sheet conveying direction, and wherein the sheet shifting section shifts each sheet of the bundle of sheets so as to shift a position of the vertically-punched cutout on the edge of each sheet so that the oblique cutout portion is formed along the width of the back side of the bundle of sheets.

4. The bookbinding apparatus described in claim 1, wherein the oblique cutout portion forming section is located at an upstream position of the sheet bundle accommodating section.

5. The bookbinding apparatus described in claim 1, further comprising:

an operating section for selecting whether or not the oblique cutout portion is formed and for setting the selection result.

6. The bookbinding apparatus described in claim 1, wherein the oblique cutout portion forming section comprises a fixed die, a punch, and a driving section for driving the punch to move upwardly or downwardly to come in engagement or disengagement with the fixed die.

7. The bookbinding apparatus described in claim 1, wherein the oblique cutout portion forming section is further adapted to form a hole on each sheet and the oblique cutout portion forming section controls a stop position of each sheet in accordance with a mode to form the vertically-punched cutout or an another mode to form the hole.

8. The bookbinding apparatus described in claim 2, wherein the oblique cutout portion forming section controls a shift distance of the cutting section shifted by the shifting section based on a bookbinding condition set for the booklet to be produced.

9. The bookbinding apparatus described in claim 3, wherein the oblique cutout portion forming section controls a shift distance of each sheet shifted in the sheet width direction by the shifting section based on a bookbinding condition set for the booklet to be produced.

10. The bookbinding apparatus described in claim 1, wherein the oblique cutout portion forming section comprises a shiftable cutting section shiftable in a sheet width direction and a fixed cutting section fixed at a predetermined position along the sheet width direction.

11. The bookbinding apparatus described in claim 1, wherein the oblique cutout portion forming section forms an oblique line-shaped cutout portion as the oblique cutout portion.

12. The bookbinding apparatus described in claim 1, wherein the oblique cutout portion forming section forms plural oblique line-shaped cutout portions as the oblique cutout portion.

13. An image forming system, comprising:

an image forming apparatus for forming an image on a bundle of sheets; and the bookbinding apparatus described in claim 1, for receiving the bundle of sheets from the image forming apparatus and for producing the booklet including the bundle of sheets.

* * * * *